United States Patent [19]

Verachtert

[11] 4,213,731

[45] Jul. 22, 1980

[54] EXCAVATORS

[76] Inventor: Antonius P. Verachtert, Julianastraat 14, Kerkdriel, Netherlands

[21] Appl. No.: 3,531

[22] Filed: Jan. 15, 1979

Related U.S. Application Data

[63] Continuation of Ser. No. 656,376, Feb. 9, 1976, which is a continuation of Ser. No. 309,488, Nov. 24, 1972, abandoned.

[30] Foreign Application Priority Data

| | | | |
|---|---|---|---|
| Dec. 1, 1971 | [NL] | Netherlands | 7116489 |
| Apr. 19, 1972 | [NL] | Netherlands | 7205286 |
| Oct. 13, 1972 | [NL] | Netherlands | 7213935 |

[51] Int. Cl.[2] ..... E02F 3/81

[52] U.S. Cl. ..... 414/723; 37/117.5

[58] Field of Search ..... 414/723; 37/117.5

[56] References Cited

U.S. PATENT DOCUMENTS

| | | | |
|---|---|---|---|
| 2,447,150 | 8/1948 | Anderson | 414/723 |
| 2,963,183 | 12/1960 | Przybylski | 414/723 |
| 3,389,819 | 6/1968 | Schumacher | 414/723 |
| 3,512,665 | 5/1970 | Westendorf | 414/723 |
| 3,556,323 | 1/1971 | Heimmerman | 414/723 |

FOREIGN PATENT DOCUMENTS

| | | | |
|---|---|---|---|
| 161424 | 11/1957 | Sweden | 414/723 |

*Primary Examiner*—John J. Love
*Assistant Examiner*—D. W. Underwood
*Attorney, Agent, or Firm*—Wegner, Stellman, McCord, Wiles & Wood

[57] ABSTRACT

A versatile attaching structure for connecting a tool such as a soil-displacing trough to a boom having an intermediate piece connectable to a boom and an operating cylinder and with interfitting connectors between the trough and the intermediate piece movable relative to each other by rotation of the intermediate piece and which are drawn into tightly locked relation for use by fastening members.

19 Claims, 36 Drawing Figures

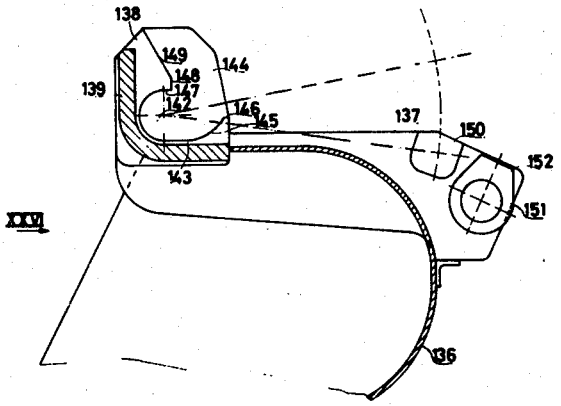
FIG.24
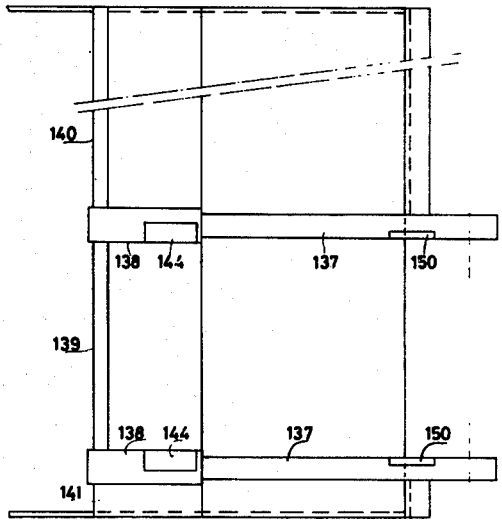
FIG.25
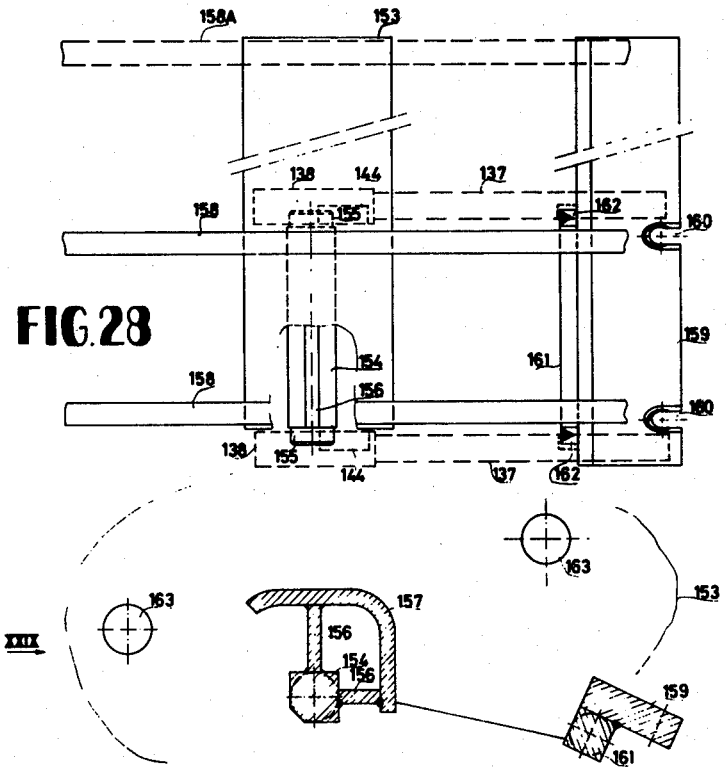
FIG.28
FIG.27

EXCAVATORS

This is a continuation of application Ser No. 656,376, filed Feb. 9, 1976, which is a continuation of application Ser. No. 309,488, filed Nov. 24, 1972, now abandoned.

The invention relates to an excavator comprising a boom and an intermediate piece pivoted to said boom and provided with two relatively parallel and interconnected ears having connecting points for pivotally connecting the boom and a setting cylinder arranged between the boom and the intermediate piece to the intermediate piece, whilst the intermediate piece comprises two spaced coupling members with the aid of which the intermediate piece can be detachably connected with connecting means fastened to an attachment, for example, a soil-displacing trough.

Excavators are known in which the boom is coupled with the aid of an intermediate piece with an attachment, for example, a soil-displacing trough; in general the coupling of the intermediate piece with the attachment is established with the aid of shafts.

In general, these known constructions are only suitable for use on a given type and make of excavator in order to enable exchange of various attachments with the given type and make of excavator. It is a further disadvantage of these known constructions that due to the use of shafts to be passed through holes in the attachment and in the intermediate piece a practically clearance-free connection cannot be obtained, even with close tolerances. In the course of time some wear is sure to occur in the connection so that a rigid connection of the intermediate piece with the attachment is no longer ensured.

In practice many types and/or makes of excavators are employed arbitrarily and since in view of the great diversity of connections with the booms of various types and/cr makes of excavators a free exchange of various types of attachments has hitherto not been possible, it is necessary to provide a plurality of different attachments, for example, various types of soil-displacing troughs and the like for each excavator.

The invention has for its object to provide an excavator of the kind set forth with which by using a universal intermediate piece a free exchange of attachments, particularly of soil-displacing troughs is possible, irrespective of the type and/or the make of excavator.

In order to effectively obtain a free exchange the intermediate piece should be appropriate for any type of boom so that the coupling points of the boom and the setting cylinder on the intermediate piece, particularly with soil-displacing troughs, maintain a most advantageous position relative to the trough, inter alia with a view to a most effective transfer of forces to the trough and to an optimum swing of the trough relative to the boom in operation. It is, of course, desirable to have a possibility of coupling, apart from soil-displacing troughs other attachments such as profiled troughs, demolition hammers, augers, vibrating plates, breaking tines and the like with the excavator by means of the intermediate piece. In order to ensure the full use of the universal exchangeability of the attachments it is required for an attachment to be effectively fixable to the intermediate piece without the need for special expedients, whilst at the same time a satisfactory clamping connection of the attachment with the intermediate piece is ensured. According to the invention this can be achieved by constructing the intermediate piece so that, when the intermediate piece is coupled with a soil-displacing trough one of the coupling members is located near the top edge of the trough, viewed in the longitudinal direction of the upper edge of the open front side of the trough across which the material can be slid into the trough in operation, whilst one of the coupling members with the associated connecting member is constructed so that it permits rotatably coupling the intermediate piece with the attachment so as to be pivotable about a rotary shaft extending parallel to the front face, whereas the second coupling member with the associated connecting member comprises clamping means by which the intermediate piece can be clamped tight to the attachment, there being furthermore provided means which permit performing a displacement of the intermediate piece transversely of the longitudinal axes of rotation. The construction is preferably such that at the last part of the turn about the rotary shaft, when the clamping means are fixed in place, the intermediate piece will bear on a supporting surface at a point spaced apart from the rotary shaft, which surface performs a displacement of the intermediate piece transverse of the longitudinal centre line of the rotary shaft.

It is then possible to arrange ears on the intermediate piece for coupling the intermediate piece with the boom at any desired relative distance from each other without involving difficulties in accommodating the coupling members and the associated connecting means. Since at least one of the coupling members with the associated connecting means is located near the top edge of the open front side of the trough, the intermediate piece is fastened to the trough as closely as possible to the front side, whilst without any difficulty the ears may extend as far as in front of the open front side for coupling the boom with the intermediate piece in front of the plane of the open front side. The universal construction embodying the invention furthermore satisfies the requirement that a satisfactory clamping joint should always be obtainable in a simple manner, since when the clamping means are fixed in place a displacement of the intermediate piece transverse of the longitudinal centre line of the pivotal shaft is at the same time performed so that also at the coupling member and the connecting means comprising said pivotal shaft the parts of the intermediate piece and the attachment are vigourously urged one against the other and a clamping joint is also obtained here.

In this manner the intermediate piece provides for each excavator not only an optimum location of the coupling points of the boom and the setting cylinders with respect to the ground-displacing trough, if a soil-displacing trough is coupled with the intermediate piece, but also a simple possibility of providing other attachments such as profiled troughs, demolition hammers, augers, vibrating plates, breaking-up tines and the like at suitable areas with connecting members with the aid of which the intermediate piece can be coupled with the various attachments in a simple and rapid manner.

According to a further aspect of the invention the coupling member on the intermediate piece or the trough is formed by a projecting member which fits in a recess in a connecting member arranged on the trough or on the intermediate piece respectively, whilst the projecting member and the fastening member are constructed so that at least at the initial insertion of the projecting member into the recess of the fastening member and at the lift of the trough with the aid of the boom a turn of the coupling member and of the fastening member about at least two at least substantially orthogonal shafts can be performed, the coupling member and the fastening member being furthermore constructed so that, when the projecting member is located in the fastening member, the intermediate piece and the trough can be turned relatively to each other in order to position correctly the boom and the trough.

By using such an intermediate piece with coupling members and fastening members on the trough the operator of the excavator can pick up the trough practically in any desired position without the need for manoeuvring the excavator in an accurately defined position relative to the trough. When subsequently the trough is lifted, a relative displacement of the trough with respect to the boom will automatically occur owing to the chosen form of the coupling member and of the fastening member so that the trough gets into a position relative to the boom which is suitable for establishing the coupling.

The connection between the intermediate piece and the attachment is preferably constructed so that, when a fastening member is secured in place in normal manner, a predetermined pre-stress is automatically produced in a controllable manner at the two spaced areas where the intermediate piece is in contact with the attachment, the intermediate piece engaging the attachment solely at said two areas. It is thus ensured that the intermediate piece is invariably fixed by the same force so that a satisfactory engagement and stress distribution at the various contact points between the intermediate piece and the attachment are ensured.

According to a further aspect of the invention means are provided to which, after the desired pre-stress is produced mechanically, the intermediate piece is immovably fixed in place with respect to the attachment whilst the pre-stress is maintained. In this way complete fixation of the intermediate piece relative to the attachment is obtained, whilst the desired mechanism of forces at the various contact points between the intermediate piece and the attachment is maintained.

For a better understanding of the invention and to show how the same may be carried into effect, reference is made by way of example to the accompanying drawings showing a few embodiments of the construction in accordance with the invention.

Figure 16:
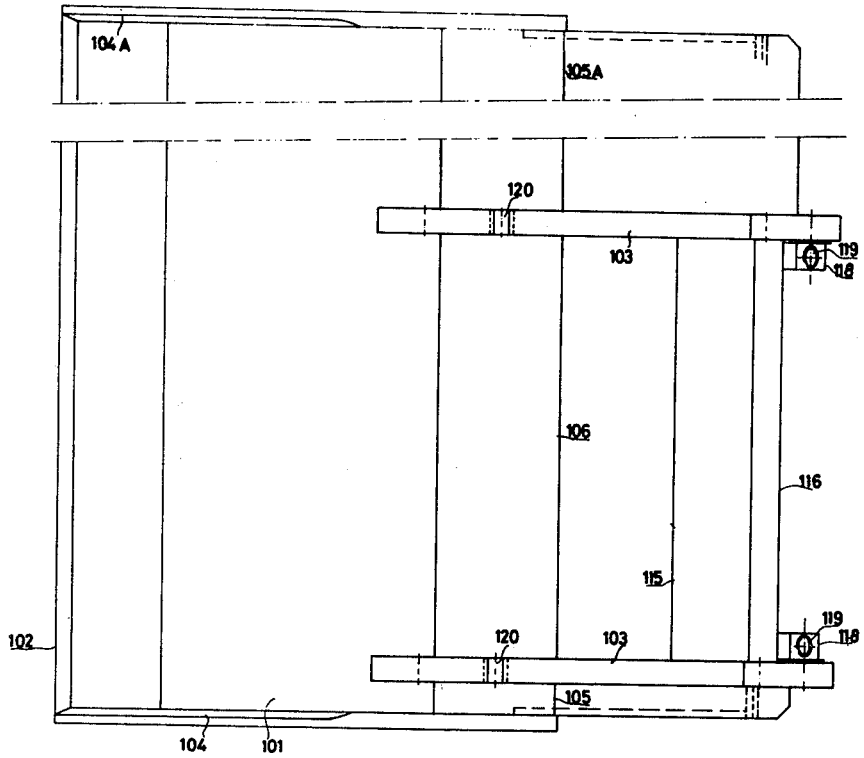
Figure 15:
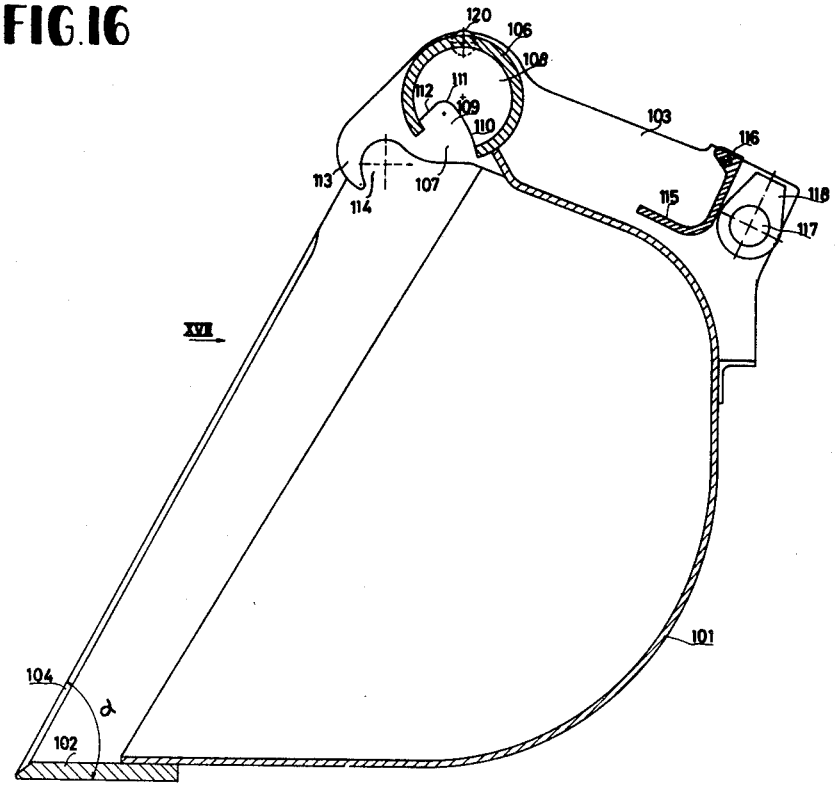
FIG. 15 is a sectional view of a soil-displacing trough with connecting means embodying the invention.

FIG. 16 in a plan view of the trough of FIG. 15.

Figure 17:
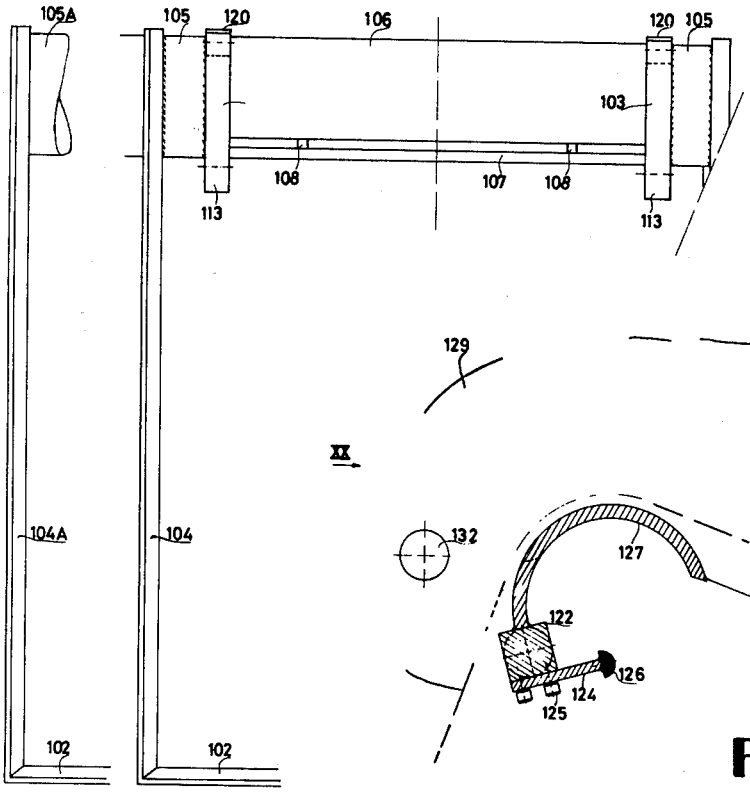

FIG. 17 is a side elevation of the trough of FIG. 15 taken in the direction of the arrow XVII in FIG. 15.

Figure 18:
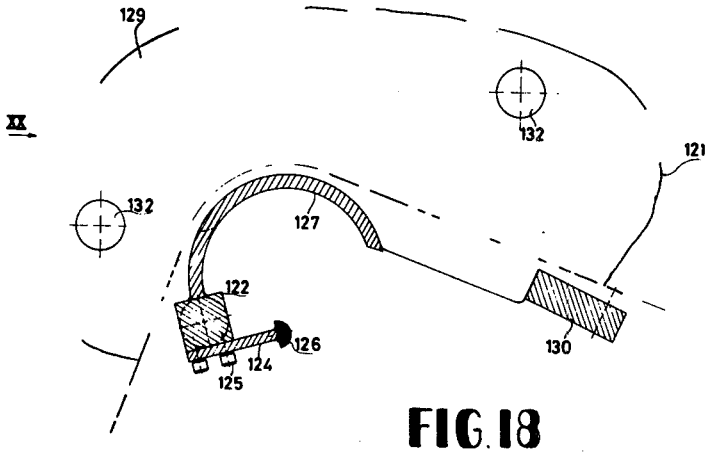

FIG. 18 is a sectional view of an intermediate piece embodying the invention.

Figure 19:
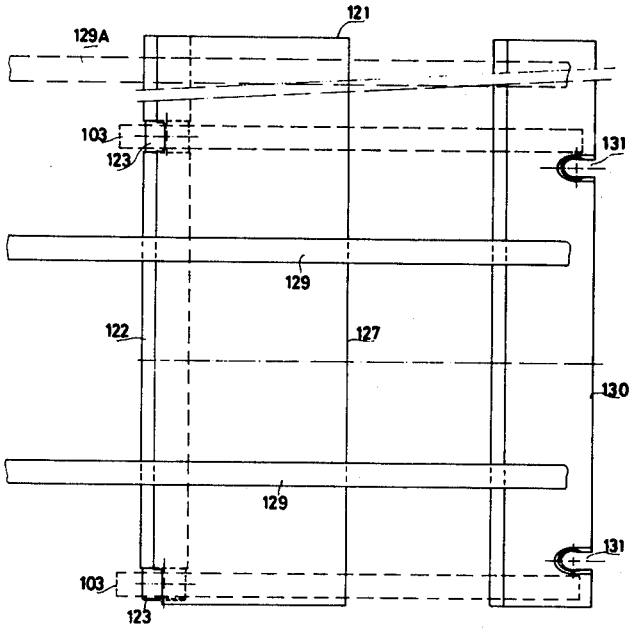

FIG. 19 is a plan view of the piece shown in FIG. 18.

Figure 4:
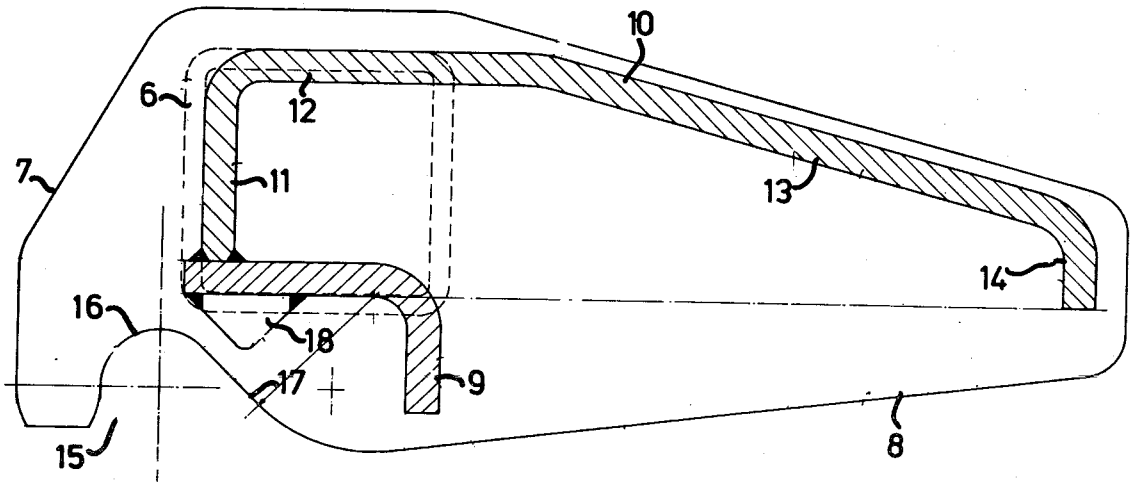
FIG. 4 is a sectional view of the part of the coupling member shown in FIG. 3 to be fastened to the trough.
Figure 7:
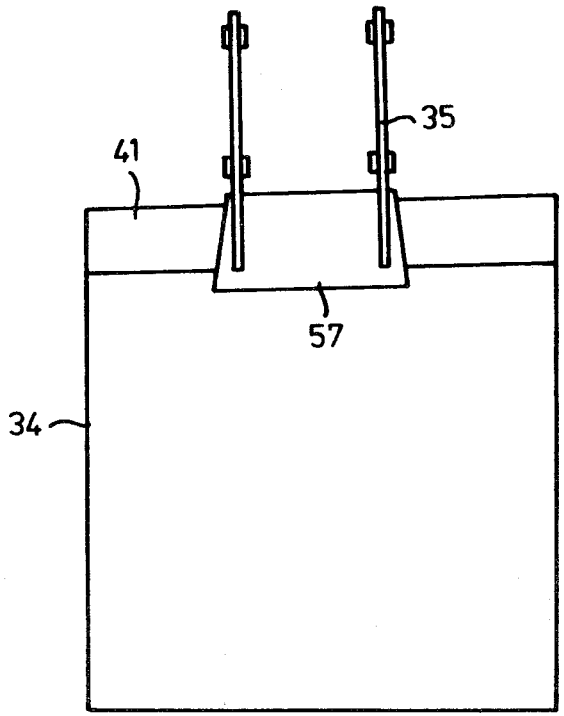
FIG. 7 is an elevation of the arrangement of FIG. 6 in the direction of the arrow VI in FIG. 6, the boom being omitted.
Figure 20:
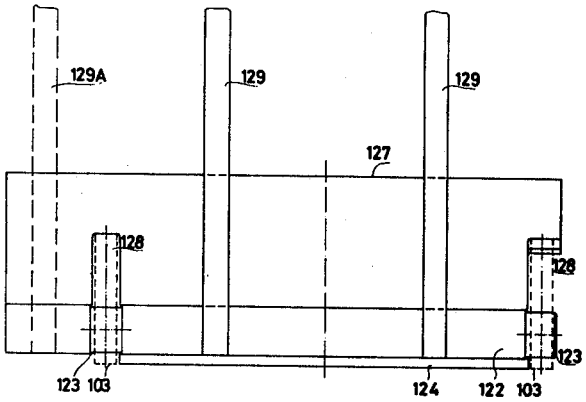

FIG. 20 is an elevation of the arrangement of FIG. 4 taken in the direction of the arrow XX in FIG. 18.

Figure 21:
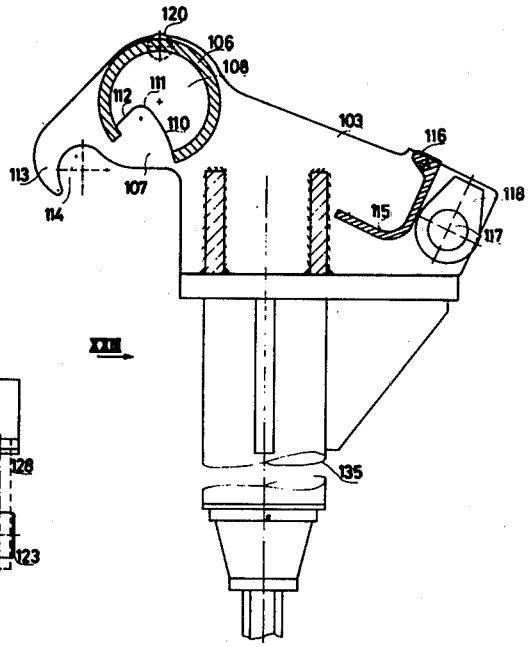

FIG. 21 is a sectional view of a breaking-up hammer provided with connecting means embodying the invention.

Figure 22:
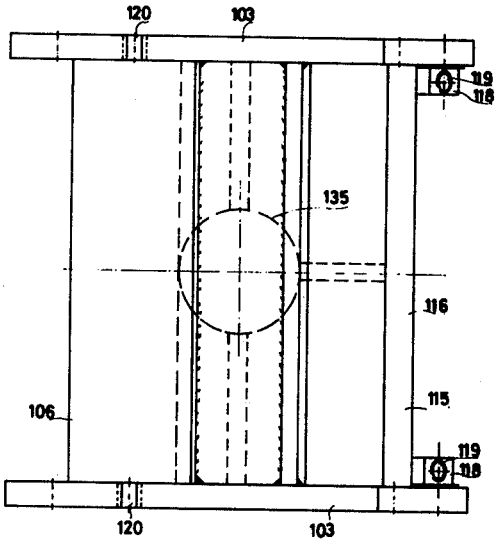

FIG. 22 is a plan view of the hammer of FIG. 21.

Figure 23:
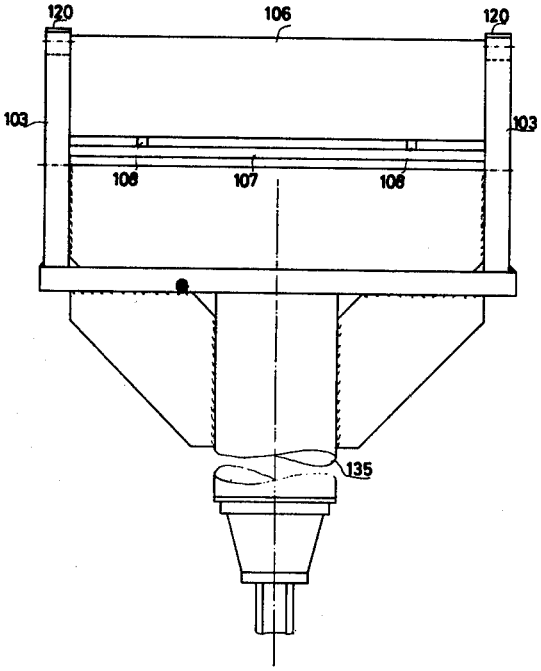

FIG. 23 is an elevation of the hammer of FIG. 21 taken in the direction of the arrow XXIII in FIG. 21.

FIG. 24 is a sectional view of a soil-displacing trough having connecting means in a second embodiment of the invention.

FIG. 25 is a plan view of the trough of FIG. 24.

Figure 26:
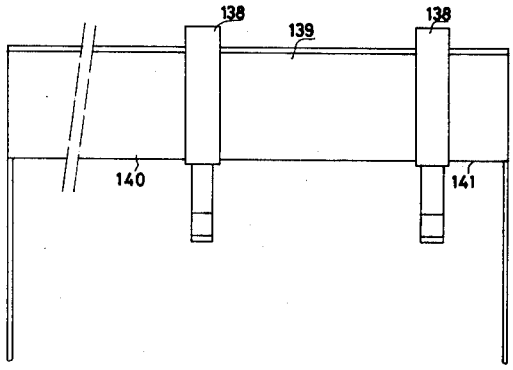

FIG. 26 is an elevation of the trough of FIG. 24 taken in the direction of the arrow XXVI in FIG. 24.

FIG. 27 is a sectional view of an intermediate piece suitable for use with the connecting means shown in FIGS. 24 to 26.

FIG. 28 is a plan view of the means shown in FIG. 27.

Figure 29:
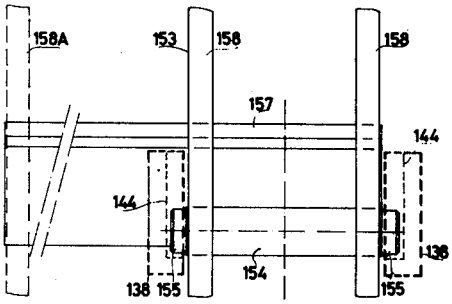

FIG. 29 is an elevation of the means of FIG. 27 viewed in the direction of the arrow XXIX in FIG. 27.

Figure 30:
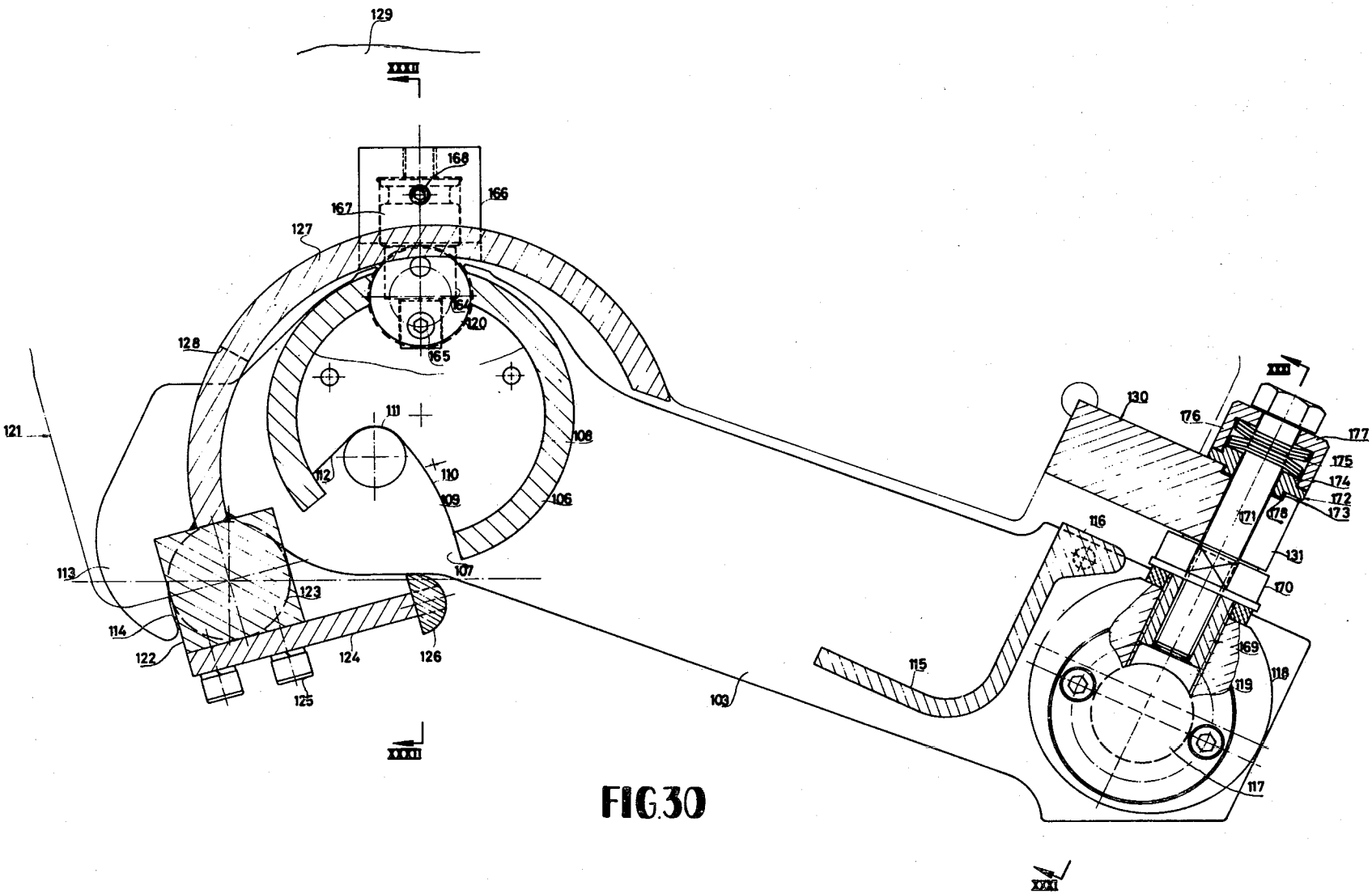

FIG. 30 is a sectional view of part of a soil-displacing trough and an intermediate piece coupled herewith.

Figure 31:
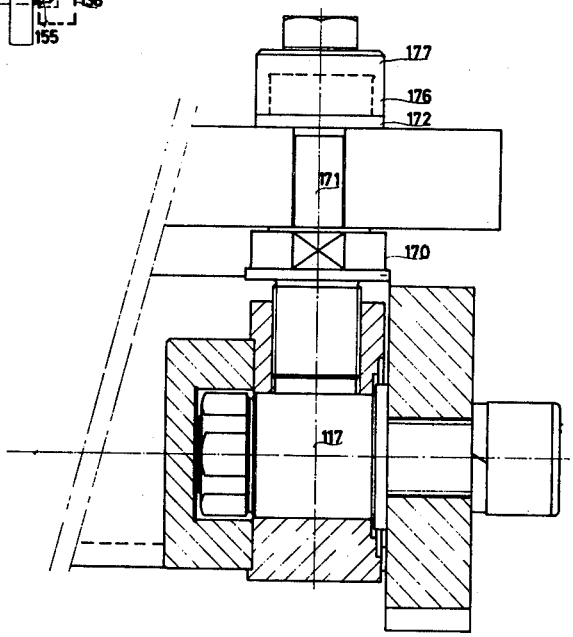

FIG. 31 is a sectional view of the arrangement of FIG. 30 taken on the line XXXI—XXXI in FIG. 29.

Figure 32:
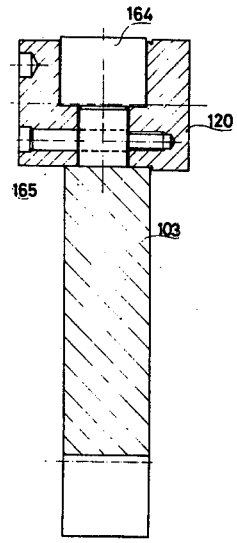

FIG. 32 is a sectional view of the arrangement of FIG. 30 taken on the line XXXII—XXXII in FIG. 30, only a plate secured to the trough and a pressing member secured to said plate being shown.

Figure 33:
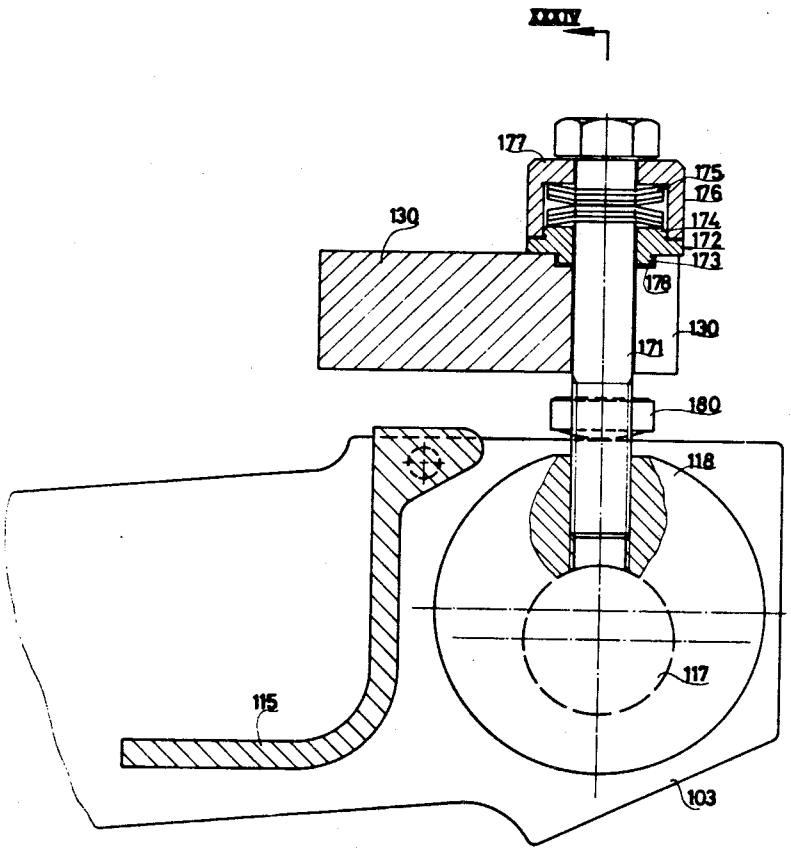

FIG. 33 shows part of a further embodiment of the connection of an intermediate peice.

Figure 34:
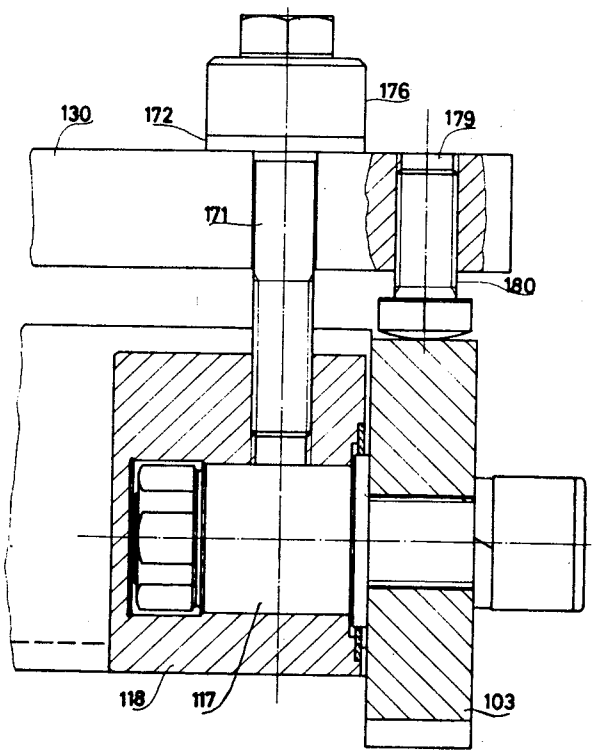

FIG. 34 is a sectional view of the arrangement of FIG. 33 taken on the line XXXIV—XXXIV in FIG. 33.

Figure 35:
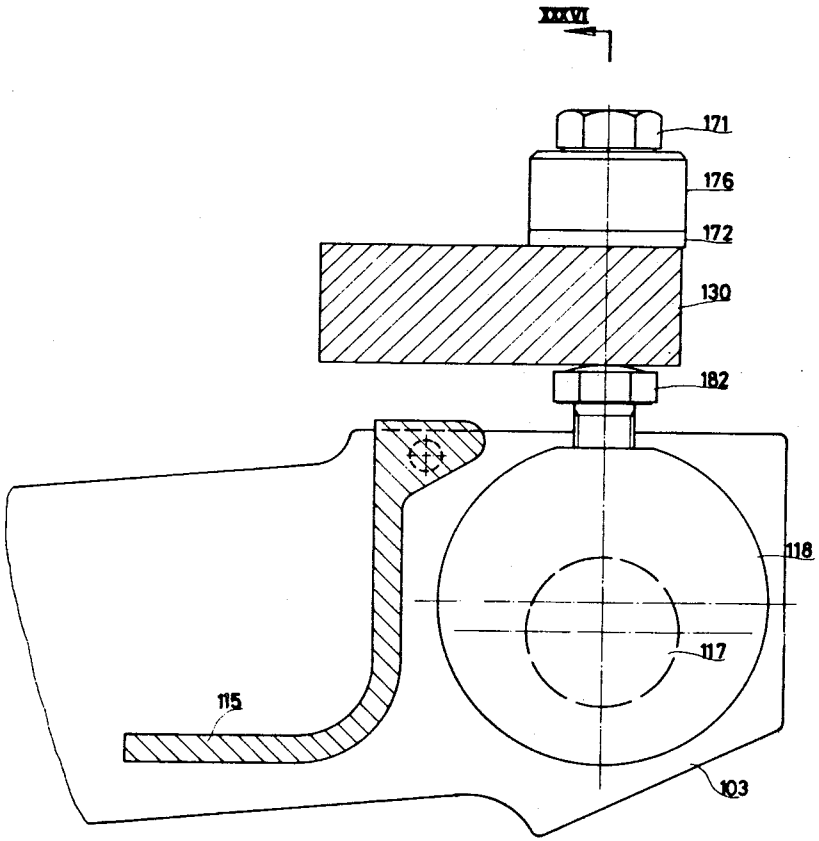

FIG. 35 shows part of a further embodiment of the connection of the intermediate piece.

Figure 36:
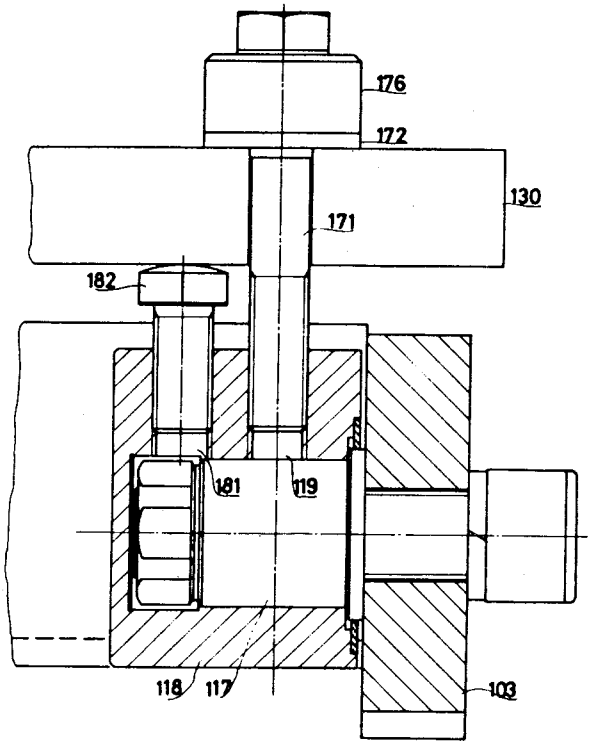

FIG. 36 is a sectional view of the connection of FIG. 35 taken on the line XXXVI—XXXVI in FIG. 35.

Figure 1:
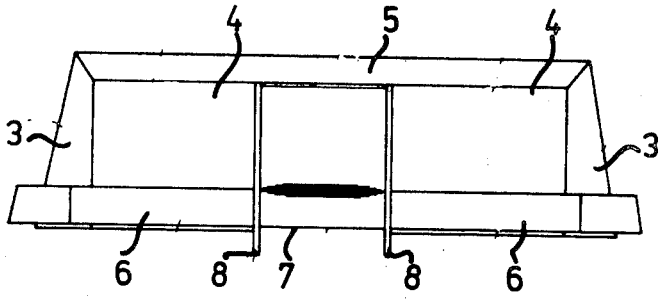
FIG. 1 is a schematic plan view of a soil-displacing trough embodying the invention.
Figure 2:
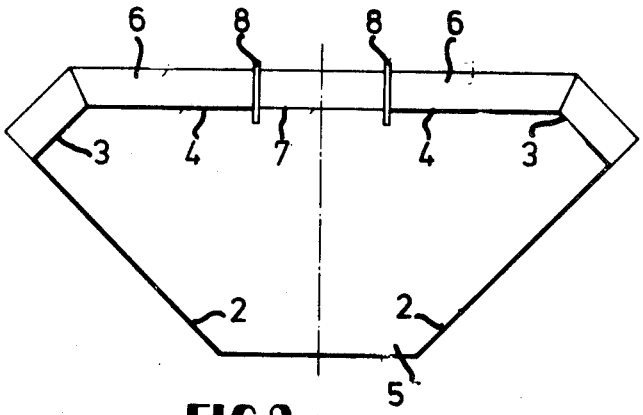
FIG. 2 is a front view of the trough shown in FIG. 1.

The trough shown in FIGS. 1 and 2 comprises a bottom plate 1 and sidewalls 2 extending from the bottom plate in diverging upwardly inclined directions and connected at their upper edges by means of upwardly inclined converging sidewalls 3, having top plates 4 extending parallel to the bottom plate. On the rear side the trough is closed by a rear wall 5. Beams 6 extend along the top sides of the sidewalls 3 and the top plates 4.

The space between the facing edges of the top plates 4 is occupied by a portion 7 of a coupling member, which portion 7 is preferably assembled separately from the trough and subsequently welded in a recess provided for this purpose in the trough. In this embodiment the portion 7 comprises two plates or ears 8, extending vertically upwards in normal operation, between which an I-section beam 9 is welded so that the long limb of the beam extends in the direction of length of the plates 8 and the short limb of the beam extends in downward direction with respect to the long limb.

Between the two plates a ridge 10 formed by folded sheet is welded, said ridge comprising a portion 11 extending vertically upwards away from the top side of the long limb of the beam 9 and a rearwardly extending portion 12 at right angles to the former, said portion 12 terminating at the end remote from the portion 11 in a slightly downwardly inclined portion 13, the end of which is bent over to form a portion 14, extending at least substantially parallel to the portion 11.

The parts of the plates 8 located partly beneath and partly in front of the beam 9 and the ridge plate 10 have a recess 15, the part 16 of which has the form of an arc of a circle and terminates rearwardly in a curved part 17, the form of which is such that in rearward direction the height of the portion of the plate 8 located beneath the horizontal limb of the beam 9 gradually increases.

Near the front end of the horizontal limb of the beam 9 on the bottom side thereof a nose 18 is welded between the plates 8, the section of said nose being at least substantially triangular.

In order to avoid the risk of bending of the ends of the plates 8 projecting in front of the beams 6 during the welding operations and/or in operation, strut plates 19 (FIG. 3) are arranged between these freely projecting ends and the ends of the beams 6.

Figure 3:
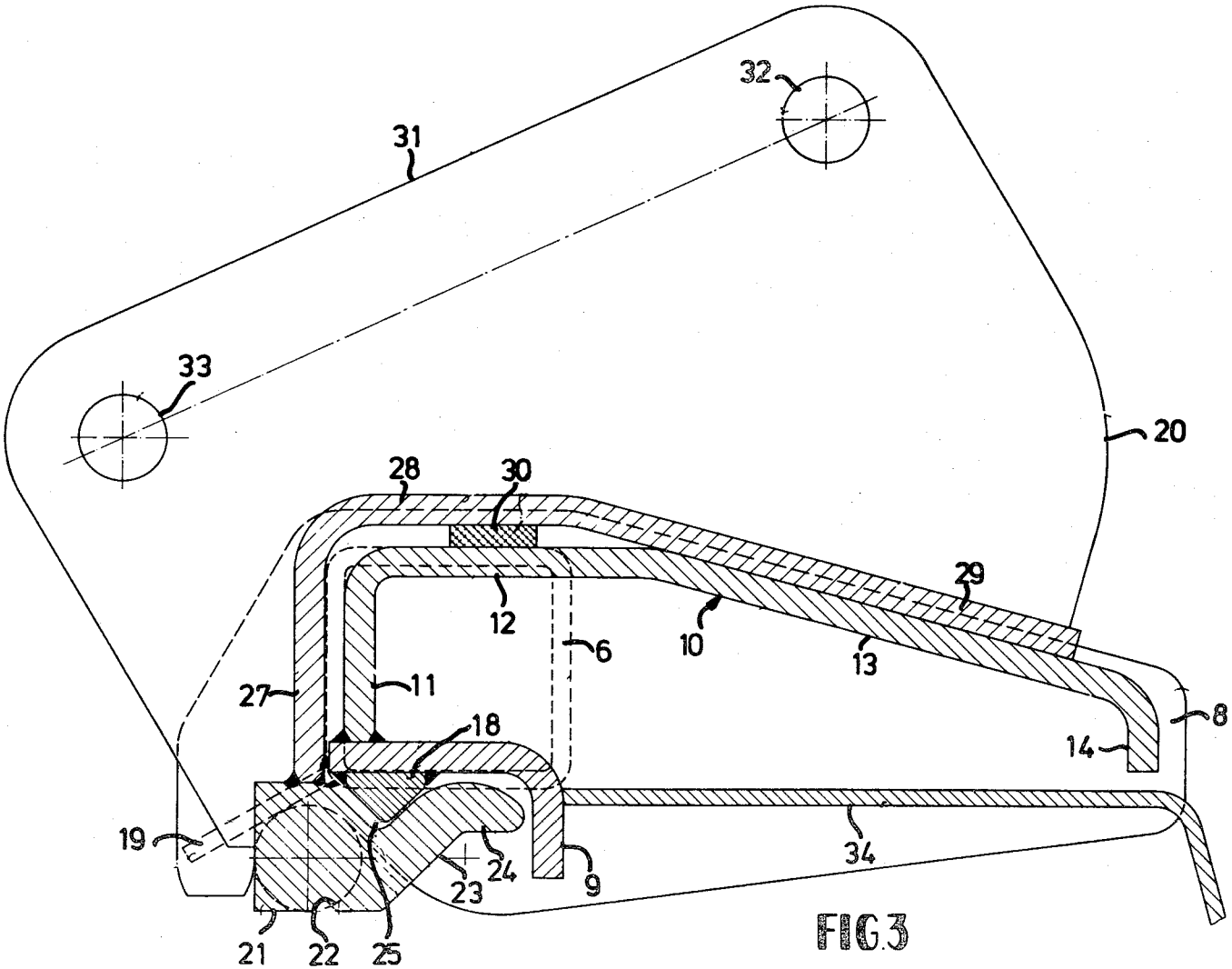
FIG. 3 shows on an enlarged scale a bipartite coupling member partly in a sectional view and partly in an elevation.
Figure 5:
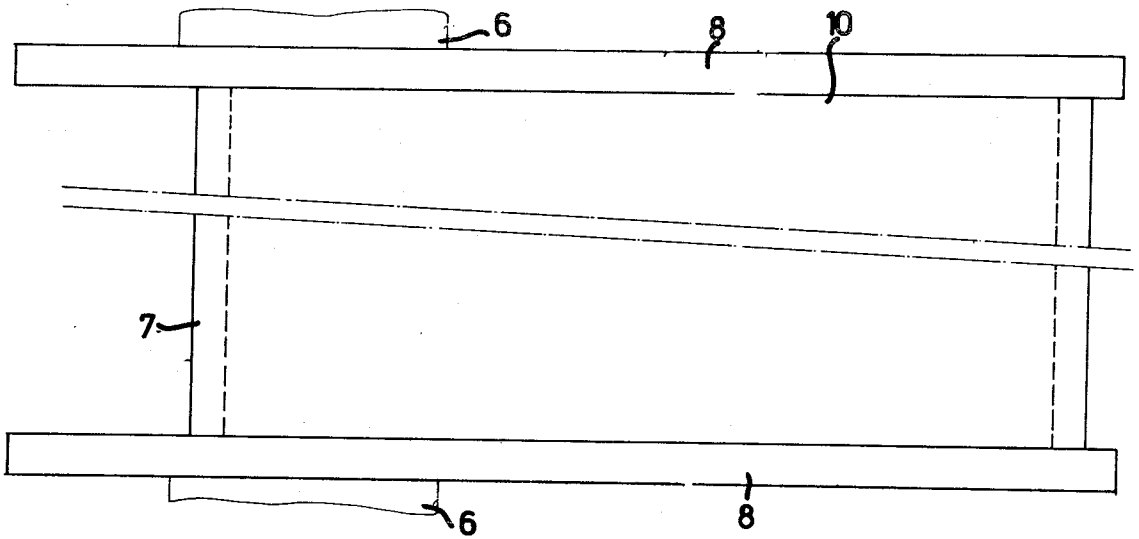
FIG. 5 is a plan view of the part shown in FIG. 4.

FIG. 3 illustrates the combination of the part 7 with a second part or intermediate piece 20 in the relative positions of these parts when rigidly connected with each other, which positions they will occupy in operation.

The second coupling member comprises an elongated block at the ends of which round stub shafts 22 are integral with said block. An upwardly inclined wing or projecting member 23 forms part of the elongated block 21; near the top end said wing terminates in a more or less horizontally bent-over toe 24 (see FIG. 3). The wing 23 and the toe 24 are preferably constructed so that the width gradually decreases in the direction of the toe. The Figure shows furthermore that the plane bounding the top sides of the wing 23 and the toe 24 is curved and that between the wing 23 and the block 21 a recess 25 is provided, the shape of which slightly corresponds with that of the nose 18, but is constructed so that in the coupled position shown the nose 18 is free of the block 21 and of the wing 23. The stub shafts 22, however, engage the boundaries 16 of the recesses 15 in the ears 8.

The block 21 has welded to it a ridge plate 26, whose end 27 welded to the block 21 extends, in the position shown in FIG. 3, parallel to the portion 11 of the ridge 10. This portion 27 is joined by a portion 28 extending parallel to the portion 12, whereas the portion 28 terminates in a portion 29 extending parallel to the portion 13. By means of bolts, clamping members or the like (not shown) the portion 29 is clamped tight to the portion 13 of the ridge. A strip 30 of elastic material is arranged between the portions 12 and 28. The arrangement is such that, when the portion 29 of the ridge plate 26 is clamped to the portion 13 of the ridge 10, the ridge plate so to say turns slightly around the point of application near the strip 30, the latter being slightly depressed, whilst a pre-stressed engagement of the second portion 20 of the coupling member near the stub shafts 22 and the portion 29 with the first portion 6 of the coupling member is obtained.

To the ridge plate 26 are secured upwardly extending ears 31 having holes 32 and 33, which form coupling points. These holes 32 and 33 can pass pins for connecting the ears with the boom of an excavator and with a setting cylinder respectively arranged on the boom. It will be obvious that the first part 7 can be constructed in the same way for all troughs and/or excavators, whilst at the intermediate piece 20 only the distance between the ears and the position of the coupling points 32 and 33 need be adapted to a given type and/or make of excavator.

Normally the intermediate piece 20 will first be coupled with the boom and with the setting cylinder, whilst in general between the intermediate piece and the setting cylinder a connecting rod will be pivotally coupled both with the intermediate piece and with the setting cylinder.

The intermediate piece can then be turned with the aid of the setting cylinder with respect to the boom so that the toe 24 extends substantially upwardly. Then the toe 24 can be urged against the beam 9 behind the nose, after which the beam can be lifted by means of the boom. Owing to the large clearance provided for the insertion of the toe 24 into the space between the nose 25 and the downwardly extending portion of the beam 9, the toe 24 can be passed into said space in practically any position of the trough relative to the boom, so that it is not necessary for the trough to be in an accurately defined position relative to the boom. As soon as the toe 24 is in some position or other in the space between the nose 25 and the hindmost portion of the beam 9, the top of the toe 24, when the boom sweeps upwardly, will come into contact with the horizontal limb of the beam 9 so that the trough will be lifted.

Subsequently the intermediate piece 20 can be turned with the aid of the setting cylinder with respect to the boom so that the top face of the toe 24 and the wing 23 will shift down along the bottom side of the horizontal limb of the beam 9 and/or along the face of the nose 18 facing the toe and the wing so that the nose 18 will be lowered into the recess 25, the trough being thus automatically aligned to the intermediate piece 20. Towards the termination of the turn described above the projecting stub shafts 22 will be located in the recesses 25, whilst the portion 29 of the ridge plate 26 will substantially be in contact with the portion 13 of the ridge 10, so that it can be clamped to said portion.

It will be obvious that in this manner an effective coupling of the trough with the boom can be rapidly established, whilst the construction is sufficiently rugged for avoiding soiling and/or corrosion of the various coupling members and fastening members such as the block 21 with the stub shafts 22 and the wing 23 and the beam 9.

FIG. 3 shows furthermore that in the embodiment shown a plate 34 in line with the plates 4 is arranged between the ears 8 for closing the trough 6 on the top side.

The coupling holes 32 and 33 are preferably designed so that either of them can be coupled directly with the boom, whilst the coupling area not connected with the boom can be connected with the setting cylinder. This permits using a trough both with a deep-shovel excavator and a high-shovel excavator.

Figure 6:
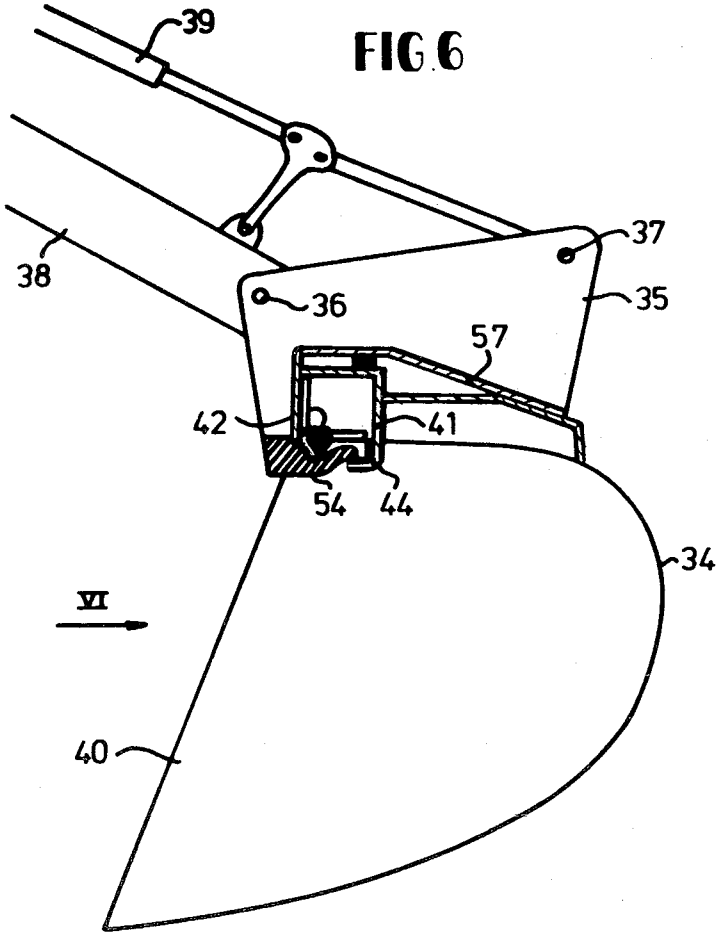
FIG. 6 is a schematic sectional view of a trough fastened to the end of a boom.

The embodiment shown in FIG. 6 is that of a soil-displacing trough 34, with which an intermediate piece 35 is coupled. The intermediate piece 35 is provided with two connecting areas 36 and 37, at which by means of parallel shafts the intermediate piece is pivoted to the end of a boom 38 and to a setting cylinder 39.

Near the open front side 40 of the trough, on the top side of the trough, a normally horizontal supporting beam 41 is fastened. In this embodiment the supporting beam 41 is formed by a hollow beam, but obviously a differently shaped beam may be used as well.

Figure 8:
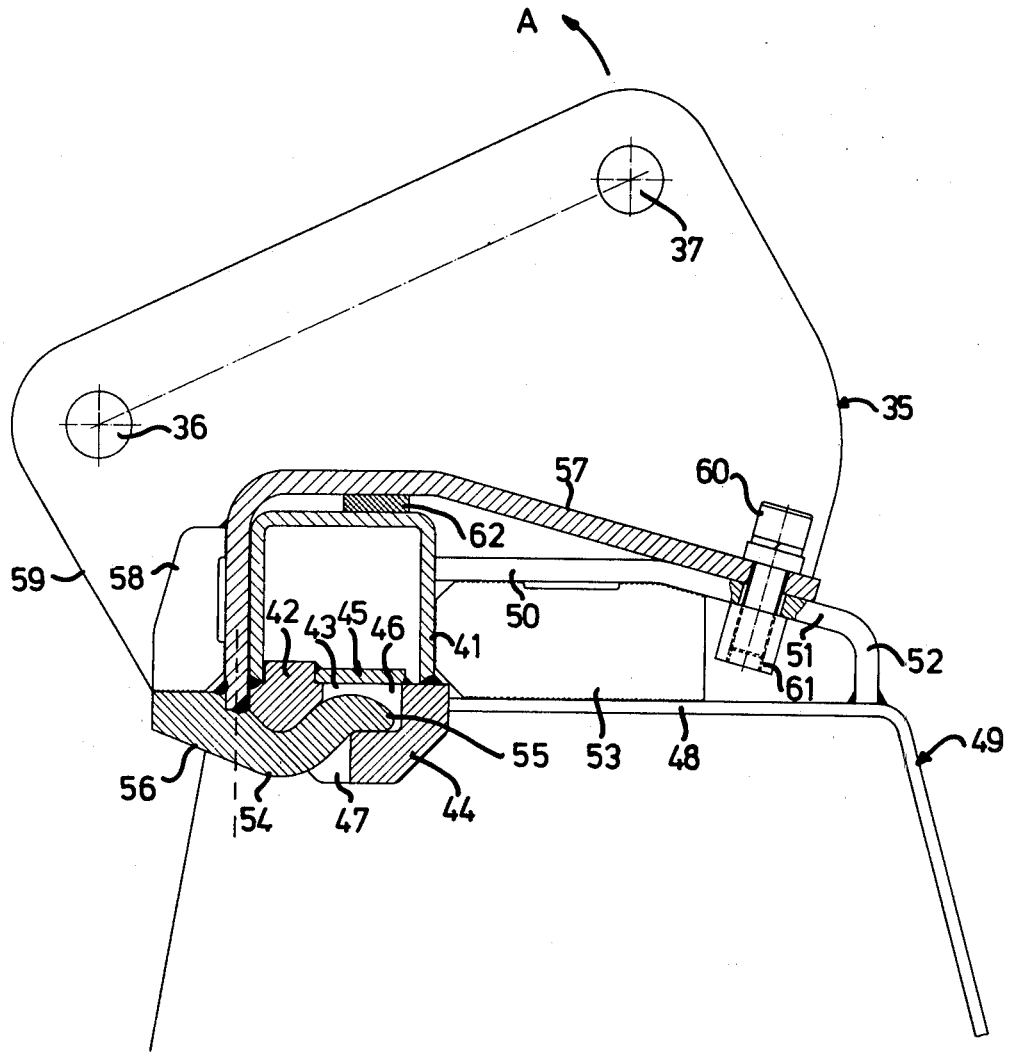
FIG. 8 is an enlarged sectional view of the coupling between the intermediate piece and the trough.

At the front side of the beam 41, near its bottom side and at its centre, a downwardly extending nose 42 is provided. FIG. 8 shows that the lower side of the nose has a more or less triangular section, the downwardly projecting tip being rounded off. The nose 42 is integral with plates 43 provided at the ends of the nose at right angles thereto, said plates connecting the ends of the nose 42 with an at least substantially L-shaped supporting part 44, the horizontal limb of which extends away from the vertical limb towards the nose 42. The arrangement is such that the top face of the horizontal limb of the supporting part 44 is at least substantially coplanar with the lowermost point of the nose 42, whilst the free end of said horizontal limb is located at a given distance from the nose 42. The top end of the supporting part 44 is connected with the nose 42 by means of a closing plate 45. Between the nose 42, the plates 43 and 45 and the supporting part 44 a chamber open on the bottom side is thus formed, said chamber having essentially an upper rectangular portion 46 and a portion 47 widening downwards towards the opening.

The trough of this embodiment is closed on the top side by a top wall 48 extending from the supporting member or supporting beam 41 towards the rear and terminating near the rear side of the trough in a downwardly extending rear wall 49.

At a given distance above the top wall 48 a supporting plate 50 extends parallel to said top wall and terminates at a given distance from the supporting beam 41 in a downwardly inclined plate 51, extending towards the top wall 48 and having its free end 52 bent over so that this end 52 is at right angles to the top wall 48, to which it is welded. The connection between the plates 50 and 51, the supporting beam 41 and the top wall 48 is reinforced by supporting plates 53 arranged between them.

Figure 9:
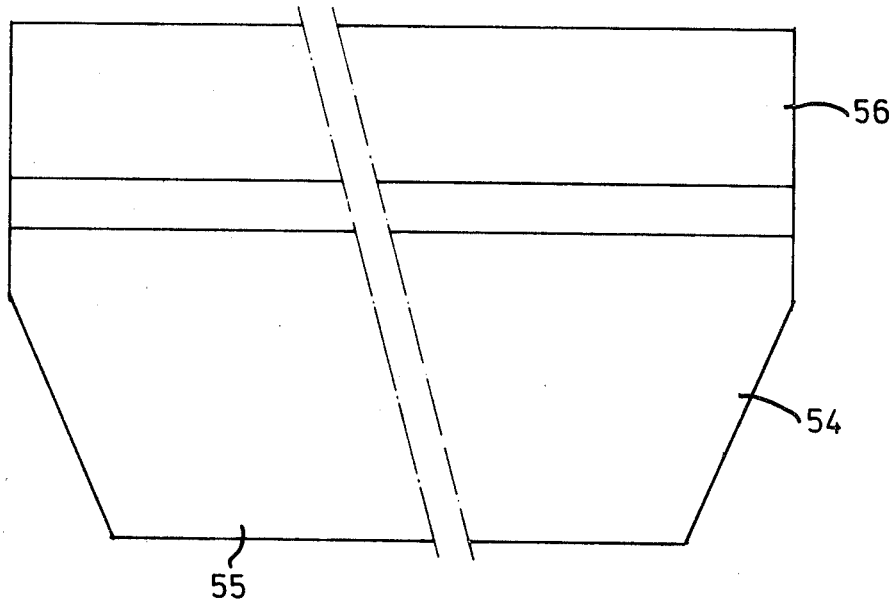
FIG. 9 is a plan view of a coupling member fastened to the intermediate piece.

The intermediate piece 35 comprises a coupling member provided with a projecting member or wing 54. From FIG. 8 it will be apparent that the coupling member has a more or less V-shaped section, the curvature of the inner side of the V corresponding with the shape of the lower portion of the nose 42. The right-hand limb of the V terminates via a gradual curve in a limb 55, which is shown in FIG. 8 in a more or less horizontal position. The other limb of the substantially V-shaped central piece of the coupling member 54 joins a foot 56. FIG. 9 shows furthermore that the width of the coupling member gradually decreases from the lowermost point of the V-shaped portion towards the toe 55.

The foot 56 is fastened to a ridge plate 57 of the intermediate piece, said ridge plate having a more or less L-shaped section (FIG. 8), one limb extending (see FIG. 8) vertically upwards along the supporting beam 41, whereas the other limb extends over and across the supporting beam, beyond which it is kinked downwardly so that the free end of the second limb engages the plate 41. The connection between the foot 56 of the coupling member and the ridge plate 57 is furthermore reinforced by strut plates 58.

To the ridge plate 57 are fastened ears 59 formed by plates at right angles to the ridge plate, in which the connecting areas 36 and 37, formed by holes for receiving shafts, are provided.

The plate 51 and the end of the ridge plate 57 engaging the plate 51 have holes for receiving bolts 60. The bolts 60 are screwed in tapped holes in a plate 61, located beneath the plate 51. A member formed in this case by a strip 62 of elastic material is arranged between the supporting beam 41 and the ridge plate 57. If desired, springs or the like may be used for this purpose.

The design of the various parts is such that, when the bolts 60 are tightened, the supporting plate 57 tends to turn slightly about the elastic supporting member 62 so that the coupling member 54 will be urged by pre-stress against the nose 42.

For discoupling the trough 34 from the intermediate piece 35 the bolts 60 can be removed. Subsequently, by means of the setting cylinder coupled with the intermediate piece 37 the intermediate piece 2 can be turned in the direction of the arrow A. The coupling member will thus turn relatively to the fastening member formed by the parts 42 to 45 mainly about a point of rotation located near the end of the top face of the horizontal limb of the supporting member 44, the member 54 thus rolling down the nose 42. After the coupling member has turned through a given angle, the shape of the coupling member described above and shown in the Figure permits withdrawing the toe of the coupling member by a downward swing of the boom from the space 46 and via the space 47 out of the fastening member so that the intermediate piece is disengaged from the trough.

For coupling the trough the reverse order of manipulations is carried out. With the aid of the setting cylinder the intermediate piece is turned relatively to the boom so that, when the trough occupies approximately the position shown in FIGS. 6 and 8, the toe 55 of the coupling member extends more or less vertically upwards. Subsequently, by turning the boom the toe 55 is slipped into the opening 47. Owing to the fairly tapering shape of the toe 55, which also tapers on its sides, it is not necessary for the longitudinal axis of the supporting beam 41 to extend accurately parallel to the centre lines of the shafts located in the openings 36 and 37. By pushing the boom against the trough the operator of the excavator can move the trough approximately into a suitable position and owing to the comparatively small dimensions of the toe 55 as compared with the comparatively ample dimensions of the open part 47 particularly wide tolerances are allowed for the position of the supporting beam 41 with respect to the centre lines of the openings 36 and 37 both with respect to angular deviations about a vertical axis and angular deviations about two horizontal, orthogonal axes. In practice it will always be possible to insert the toe 55 roughly into the opening 47, after which the trough can be lifted from the ground by swinging the boom upwardly, whilst the fastening member formed by the parts 42 to 45 will automatically be lowered along the toe 55 and the toe 55 will bear on the bottom side of the plate 45. The nose 42 and the supporting part 44 will slide along the projecting portion of the coupling member and the trough will be positioned fairly accurately with respect to the boom. Subsequently, by means of the setting cylinder 39, the intermediate piece 35 can be turned in a direction opposite the arrow A so that the various parts 42, 44, 45 and 54 are displaced relatively to each other and/or will roll relatively to each other, the parts being urged into the relative positions shown in FIG. 8 and the trough being automatically urged into the correct position relative to the boom. At the same time the elastic member 62 is automatically compressed so that sufficient pre-stress is produced for ensuring a satisfactory engagement of the coupling member with the nose 42. Then the bolts 60 can be retightened for finally fixing the intermediate piece at the second coupling point.

It will be apparent that, when using this embodiment for fastening a trough to a boom with the aid of the intermediate piece described, the trough can be simply and rapidly coupled with the boom so that the trough can readily be detached and replaced by a different digging tool or trough provided with similar fastening means as the trough described above. It is not necessary for the trough to occupy an accurately determined position relatively to the excavator before the coupling manipulation can be carried out. The distance between and the shape of the plates 59 and the position of the connecting areas 36 and 37 in the ears 59, like in the further embodiments, are adapted, as a matter of course, to the design of the boom of the make and/or type of excavator, with which the intermediate piece concerned is used. For every make and/or type of excavator intermediate pieces 35 can now be manufactured, the ears 59 of which match the type and/or make concerned, whilst the further parts and their disposition relative to each other remain the same.

Figure 10:
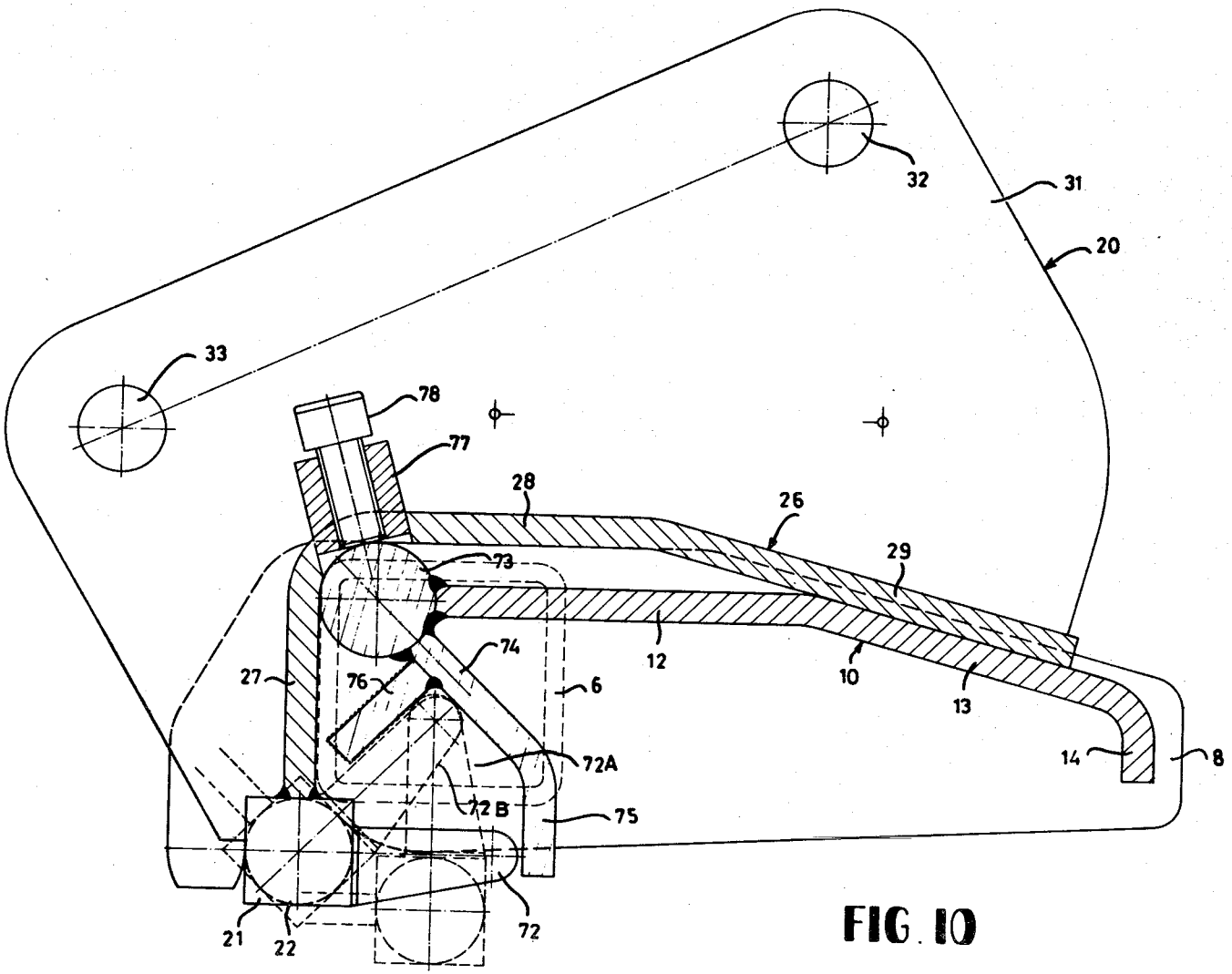
FIG. 10 shows a further embodiment of an intermediate piece and part of a trough coupled herewith.

The intermediate piece of the embodiment shown in FIG. 10 corresponds at least substantially with the intermediate piece of the embodiment shown in FIG. 3 and corresponding parts are designated by the same reference numerals. This also applies to the parts of the assembly secured to the trough.

In this embodiment, however, the curved wing is replaced by a substantially straight wing 72, the width of which preferably decreases towards the free end.

The portion 12 of the ridge 10 in this embodiment does not terminate near its front end in a portion extending perpendicularly downwards, but the portion 12 is welded at its front end to a beam 73, in this case of circular section, located between the plates 8. Beneath the plate 12 the circular-section beam 73 has welded to it a plate 74 inclined to the rear and being at an angle of about 45° to the plate 12, said plate 74 also being located between the plates 8 and terminating at the end remote from the beam in a downwardly extending plate portion 75, which is at least substantially at right angles to the plate portion 12. At the level of the beam 73 the plate 74 is provided with a strip 76, extending at right angles to the plate 74 and lying also between the plates 8. From the Figure it will be apparent that in this way a cavity is formed between the plates 76 and 74, the section of said cavity being at least substantially V-shaped. FIG. 10 shows furthermore that the transitional part between the parts 27 and 28 of the ridge plate 26 has two holes at a distance from each other, in which sleeves 77 are secured, which have internal screwthread. Bolts 78 are screwed into the sleeves.

When the intermediate piece 10 is coupled with a boom in the manner described above, the intermediate piece can be turned relatively to the boom for coupling a trough so that the projecting wing occupies the position 72A indicated by broken lines, so that it extends substantially perpendicularly upwards. It will be obvious that regardless of the position of the trough the wing 72 can be pushed into the space between the plates 74 and 76, whilst upon an upward turn of the boom the plates 74 and/or 76 will slide along the tip of the wing 72 until they occupy more or less the position shown in the Figure with respect to the wing 72. Subsequently the intermediate piece 20 can be turned with the aid of the setting cylinder with respect to the boom so that the tip of the wing 72A will roll down along the plates 76 and/or 74 to arrive gradually at the position 72B and at this instant the stub shafts 22 will fall into the recesses 15 in the plates 8. At a further turn of the intermediate piece it will turn relatively to the trough about the stub shafts 22 into the position shown in the Figure, in which the portion 29 of the ridge plate 26 can be clamped tight to the portion 13 of the ridge 10 with the aid of bolts or similar clamping members. Subsequently the bolts 78 can be tightened so that they bear on the beam 73. By tightening the bolts 78 the stub shafts 22 are tightly clamped against the boundary faces 16 and 17 of the recesses 15. Then the bolts 78 perform, in fact, the function of the elastic member referred to in the preceding embodiment.

Figure 13:
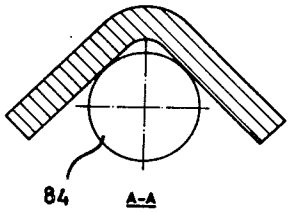
FIG. 13 is a sectional view of the piece of FIG. 11 taken on the line XI—XI in FIG. 11.
Figure 12:
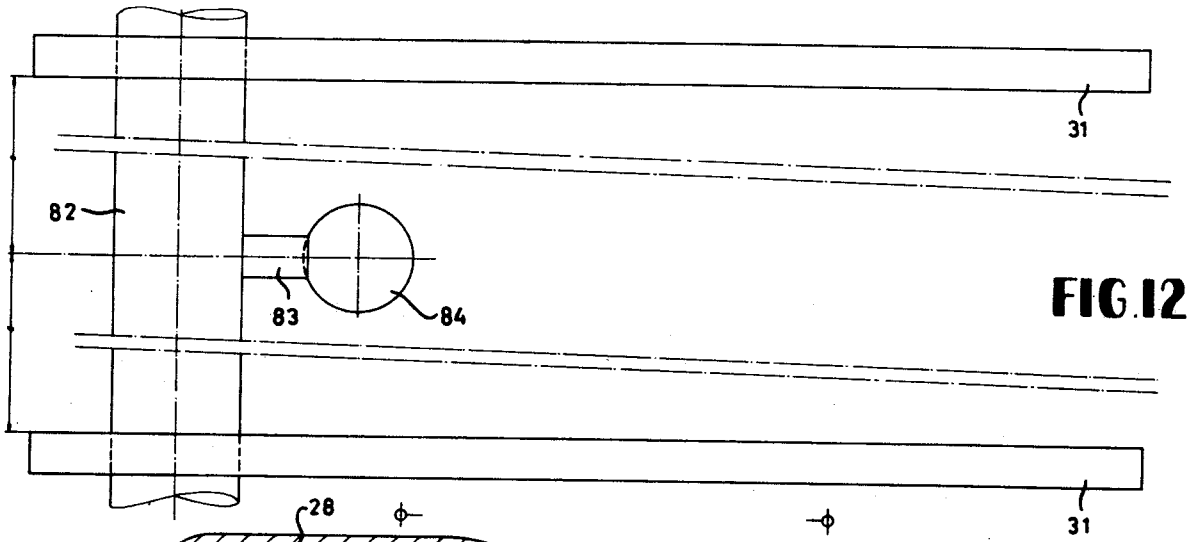
FIG. 12 is a plan view of the intermediate piece of FIG. 11.
Figure 11:
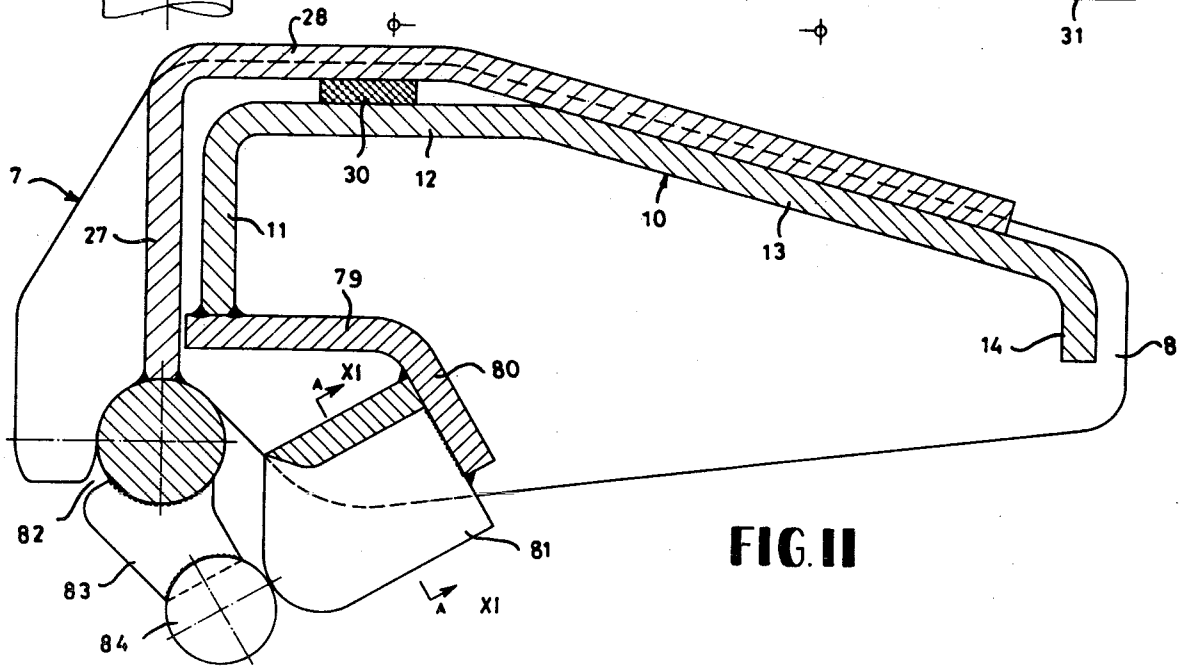
FIG. 11 shows a further embodiment of an intermediate piece and part of a trough coupled herewith.

In the embodiment shown in FIGS. 11 to 13 the part secured to the trough corresponds largely with the same part of the first embodiment and corresponding parts are designated by the same reference numerals. However, in this embodiment the lower end of the portion 11 of the ridge 10 has secured to it a plate 79, extending parallel to the plate 12 in rearward direction, the free end 80 of said plate being bent over through an angle of about 45° in downward direction. This free end has secured to it a substantially V-section fastening member or insert 81, which is open on the bottom side and which extends to the front away from the end 80. From FIG. 11 it will be apparent that the sidewalls of the insert extend further to the front than the top piece interconnecting the sidewalls.

The intermediate piece used in this embodiment corresponds at least mainly with that of the first embodiment. For the sake of clarity the ears 31 are omitted rom FIG. 11 and the ridge plate 26 is omitted from FIG. 12.

In this embodiment the lower end of the portion 27 of the ridge plate 26 has secured to it a long beam 82 of circular section, the ends of which fit in the recesses 15. At the centre the beam has welded to it a plate or support 83 at right angles to said beam, by means of which plate a ball 84 is connected with the shaft.

When the intermediate piece shown in FIGS. 11 and 12 is coupled with the boom in the manner described above, it can be turned into a position in which the ball extends upwardly with respect to the shaft 82. It will be obvious that in this position the ball 84 can be introduced readily into the insert 81, whilst very large tolerances of the position of the trough with respect to the boom are allowed.

As soon as the ball 84 is located between the sidewalls of the insert, the trough can be lifted by swinging the boom upwardly, so that the insert 81 will slide down along the ball 84 until it comes into contact with the plate 80. Subsequently, the intermediate piece can be turned so that the ball 84 rolls along the plate portion 80 towards the insert 81. The trough will then automatically find its correct position relative to the boom also becuase the support 83 can further adjust, if necessary, the turn of the trough by its contact with the sidewalls of the insert 81. It a given instant the ends of the circular shaft 82 will fall into the recesses 15 and thus ensure the definite disposition of the trough with respect to the boom. Upon a further turn of the intermediate piece the intermediate piece and the trough will turn relatively to each other about the centre line of the shaft 82, the ball 84 being thus released from the insert 81, the intermediate piece arriving at the position shown in FIG. 11, in which it can again be clamped tight against the portion 13 of the ridge 10.

Figure 14:
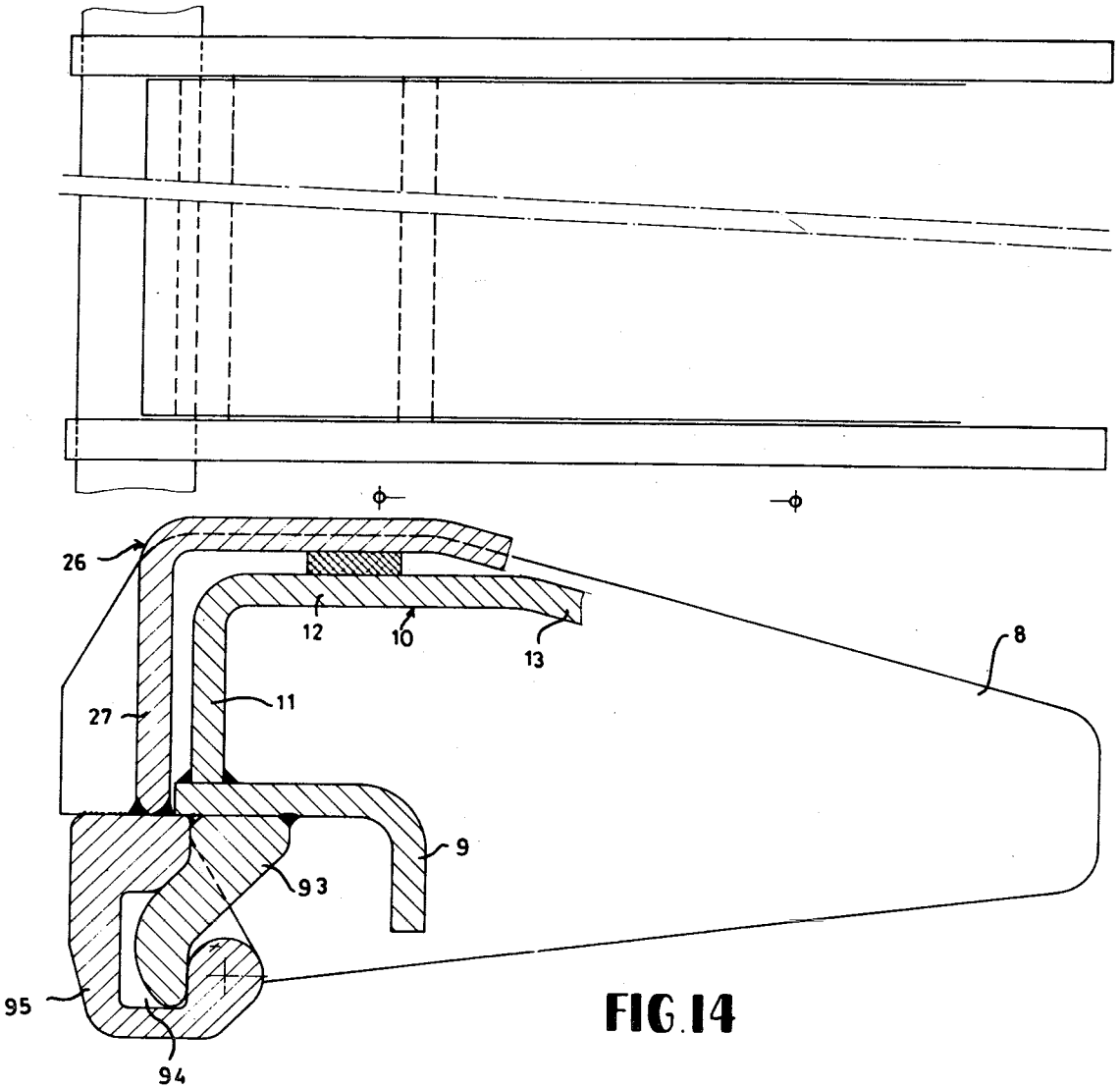
FIG. 14 shows a further embodiment of an intermediate piece and part of a trough coupled herewith.

The embodiment shown in FIG. 14 corresponds largely with that shown in FIG. 8, but the assembly at the trough is chosen more similar to that of the first embodiment and the wing 93 is secured to the trough, whilst the coupling member 95 having the recess for receiving the toe of the wing is fastened to the intermediate piece. It will be obvious that for coupling the trough the intermediate piece to which the coupling member 95 is secured has to be turned so that the access to the recess 94 is located perpendicularly beneath the toe of the wing 93, after which the boom can be swung upwardly so that the toe slides into the recess 94 and provides by its oblique edges a correct positioning in the transverse direction of the trough. Then the intermediate piece can be turned so that the toe and the coupling member 95 will relatively roll off until they finally occupy the position shown in FIG. 14. Disengagement is, of course, performed in the reverse order of operations.

FIG. 15 shows a soil-displacing trough 101 the open front side of which, where in operation the soil is pushed into the trough, is bounded by a lower knife 102, occupying a horizontal position in the Figure, and upright knives 104. The angle $\alpha$ between the upwardly inclined edge of the side knife 104 and the horizontal knife 102 is the "trough angle".

Symmetrically to the centre of the trough two vertical plates 103 are arranged near the top side of the trough. The plates 103 are connected with the sides of the trough by means of connecting beams 105. Between the plates 103 is secured a pipe 106, the bottom side of which has a slot 107 extending in the direction of length of the pipe. The pipe 106 accommodates two vertical plates 108 having more or less triangular or V-shaped recesses 109 which are open on the $\alpha$ bottom side. The extreme boundary line 110 of the recess 109 joins the hindmost boundary line of the slot 107 of the pipe 106 and subsequently extends in a slight curve inclined to the front, where it terminates in a curved portion 111, which forms part of a circle, the boundary line 111 connecting the boundary line 110 with a straight forwardly and downwardly inclined boundary line 112, which joins the inner circumference of the pipe 106 slightly above the foremost boundary line of the slot 107.

The plates 103 have noses 113 projecting in front of the pipe 106 and having recesses 114, whilst at least part of the boundary line of the recess 114 forms part of an arc of a circle.

At a given distance in front of the rear ends of the plates 103 an angle-section iron is arranged between the plates and provided along one edge with a reinforced nose 116. Behind the angle-section iron 115 the plates 103 have secured to them stub shafts 117 extending towards each other, about which discs 118 are adapted to rotate. The discs 118 have tapped holes 119.

As shown in FIG. 15, the plates 103 are provided directly above the centre of the pipe 106 with round plugs 120, which project slightly above the top ends of the plates 103.

The plates 103 and the members arranged between them and secured thereto constitute the fastening means with the aid of which an intermediate piece to be described hereinafter can be coupled with the soil-displacing trough 101. It will be obvious that also in this case the fastening means can be mounted on a trough of any width and any shape. The width can be readily varied by replacing only the beams 105 by longer beams **105*a* as shown in the left-hand part of FIG. 17 and an upper part of FIG. 16**. It is therefore possible to use not only very narrow troughs but also very wide troughs with the coupling means described above.

The intermediate piece 21 to be coupled with the boom and adapted to co-operate with the fastening means described above arranged on a trough or the like is shown in FIGS. 18 to 20.

The intermediate piece comprises a square-section bar 122, which is provided, in accordance with its length, at the ends or between the ends with round stub shafts 123, which are integral with the bar. The right-hand and lower parts of FIGS. 19 and 20 respectively illustrate the case in which the stub shafts 123 are provided at the ends of the bar 122, whereas the left-hand and top parts of the Figures respectively show the stub shafts 123 arranged between the ends of the bar 122. The stub shafts 123 are symmetrically arranged with respect to the centre of the intermediate piece and the distance between the stub shafts 123 corresponds with the distance between the plates 103 indicated schematically by broken lines in FIGS. 19 and 20.

To the bottom side of the bar 122 is clamped a plate 124 by means of bolts 125. The end of the plate 124 located behind the bar 122 is provided with a semi-circular bar 126. From the bar 122 onwards the width of the plate 124 gradually decreases towards the semi-circular bar 126 so that the plate 124 has a more or less tapering shape.

The top side of the bar 122 is provided with a substantially semi-circular-section plate 127, extending also to the rear from its fastening point at the bar 122. At the area of the stub shafts 123 the plate 127 has recesses 128. The plate 127 has two ears 129 located symmetrically to the centre of the intermediate piece. The ears 129, as is shown by solid lines in FIGS. 19 and 20, can be located between the stub shafts 123, which are then located at the ends of the bar 122. When the bar 122 is longer, the ears 129 may be spaced apart by a larger distance than the stub shafts 123, as is shown schematically in FIGS. 19 and 20 for an ear **129*a*. The distance between the ears 129 may, of course, also be equal to the distance between the stub shafts 123**.

At a given distance behind the bar 122 the ears are interconnected by means of a plate 130 having two slots 131 open at the ends. The slots 131 are also symmetrical to the centre of the intermediate piece 121.

The ears 129 have two holes 132 for coupling one end of a boom of an excavator and one end of a setting cylinder connected with said boom.

All shapes and kinds of soil-displacing troughs can be provided with the coupling means described above, care being taken that the distance between the plates 103 as well as the relative disposition of the pipe 106 with the recesses 105, the beam 114 and the stub shafts 117 with the discs 118 rotatable about the former are always the same. Also the distance between the plates 108 inside the pipe 106 and the disposition of the recesses 109 therein with respect to the further parts of the coupling means will always be the same. At the intermediate piece the dimensions and the relative distance of the stub shafts 123 as well as the relative disposition of the various parts, for example, of the stub shafts 123, the semicircular bar 126 and the plate 130 are kept the same. Also the space between the two slots 131 will always be the same. However, as stated above, the length of the bar 122 may be chosen arbitrarily and the space between the plates 129 and the disposition of the holes 132 can be chosen at will. It is thus possible to adapt the distance between the plates 129 and the disposition of the holes 132 to a given type and/or make of excavator so that the intermediate piece 121 can be coupled in optimum manner with the excavator concerned, which permits of coupling any soil-displacing trough or the like provided with the fastening means described above with any excavator equipped with said intermediate piece.

For establishing the connection the intermediate piece 121 coupled with the boom is turned so that the plate 124 extends substantially perpendicularly upwards. Then the plate 124 can be shifted upwards between the two plates 108, correct positioning of the boom with respect to the trough not being of great importance, since owing to the tapered shape of the plate 124 an orientation of the trough with respect to the boom is automatically obtained because the inclined edges of the plate 124 can slide along the inner sides of the plates 108. The semi-circular bar 126 will then move upwardly along the boundary lines 110 of the recesses 109 and contribute to the orientation of the trough with respect to the boom, when the trough is lifted. Since the boundary line 112 joins the inner wall of the pipe 106 at a distance in front of the boundary of the slot 107 the semi-circular bar 126 is prevented from snapping out of the pipe during the coupling operation. Finally the semi-circular bar will engage the semi-circular boundary lines 111, in which case the trough can already be free of the ground. Subsequently, the intermediate piece is turned with the aid of the setting cylinder with respect to the boom so that the semi-circular part 126 will roll along the upper boundary of the recesses 109 in the plates 108. At a given instant the stub shafts 123 will enter the recesses 114 and the intermediate piece will turn on about the rotary axis formed by the centre lines of the stub shafts, whilst the plate 127 will bear on the supporting faces formed by the plugs 120 for the intermediate piece and projecting above the plates 103. In this position the plate 130 is located still slightly above the nose 116. Bolts screwed into the holes 119 can then be turned into the slots 131 by turning the discs 118 out of a position turned to the rear (see FIG.15) into the position shown in FIG. 15. Then these bolts can be tightened so that the plate 130 is drawn down against the nose and the intermediate piece will tilt about the contact points between the plate 127, forming a connecting member, and the plugs 120 so that the stub shafts 123 are displaced at right angles to their centre lines and hence also at right angles to the rotary axis about which the intermediate piece is turned with respect to the trough during the coupling operation and are tightly clamped in the recesses 114. A tight connection of the intermediate piece with the trough is thus ensured.

In order to prevent expulsion of the bolts from the slots during tightening, annular grooves are provided near the closed ends of the slots in the top side of the plate 130 for receiving rings surrounding the bolts or the lower ends of the bolts.

By using the plate 130 and the pivotal bolts connected with the discs 118 a very compact, only slightly projecting structure is obtained for clamping the intermediate piece so that these parts of the coupling members and fastening means do not hinder the desired disposition of the ears 129.

Since the plates 108 are arranged inside the pipe 106, which together with the beams in line with the pipe 106 forms a boundary of the open front side of the trough at the top, and since the recesses 114 are located just in front of and slightly lower than the pipe 106, such a compact structure is obtained that the ears 129 may extend, even at the front, over a large region so that also in this embodiment an optimum disposition of the holes 132 can always be obtained for any known type and/or make of excavator.

Thereto contributes also the shape of the profiled plate 127, which extends away from the bar 122 in upward and rearward direction and intimately surrounds the pipe 106 in the coupled state.

The discs 118 can be freely slipped off the stub shafts 117 so that they can be readily replaced, for example, when the screwthread in the holes 119 is damaged.

The means described in the foregoing can be effectively mounted not only on soil-displacing troughs and the like but also on other auxiliary tools.

FIGS. 21, 22 and 23 show by way of example the fastening means connected with a breaking hammer 135. Also in this case the various parts of the fastening means are designated by the same reference numerals as in the last-mentioned embodiment. It will be obvious that all auxiliary tools commonly used on excavators may be provided in an appropriate manner with the fastening means described above so that a universal exchangeability of the tools is obtained for all makes and/or types of excavators provided with the intermediate piece described above, it only being necessary to adapt the space between the plates 129 and the position of the couplng holes 132 in the plates 129 to the make and/or type of excavator concerned.

FIGS. 24 to 26 show a soil-displacing trough 136 provided with a further embodiment of fastening means in accordance with the invention. Also in this case the fastening means comprise two vertical plates 137 spaced apart from each other by a fixed distance and provided at the front ends with thicker ears 138. An angle-section connecting beam 139 is arranged between the ears 138 and beyond the ears beams 140 and 141 are arranged in line with the beam 139, the length of said beams being adapted to the width of the trough, as is shown in FIGS. 25 and 26. The proximal sides of the ears 138 have recesses; one recess has a semi-circular portion 142 which is open at the rear and terminates at his place in the further part of the recess. It will be seen from FIG. 24 that the boundary line of the semi-circular part is joined on the bottom side by a straight boundary line 143 of the further part 144 of the recess in the plate 138. At a given distance behind the part 142 of the recess the boundary line 143 terminates in a curved, upwardly and rearwardly inclined boundary line 145, the top end of which joins a horizontal short boundary line 146, which extends up to the rear side of the ear 138. The top end of the boundary line of the part 142 joins a boundary line 147 extending parallel to the boundary line 143, the line 147 being fairly short and terminating in a boundary line 148 at right angles to the former and terminating, in turn, in an upwardly and forwardly inclined boundary line 149. It will be obvious that the part 144 of the recess in the ear 138 is open both on the top side and on the rear side.

At a given distance behind the ears 138 the plates 137 have recesses 150, which are open on the top side and which have a more or less rectangular shape. Behind the recesses 150 stub shafts 151 similar to the stub shafts 117 are secured to the plates 137 and discs 152 corresponding with the discs 118 are adapted to rotate about said stub shafts.

The intermediate piece 153 suitable for use with an auxiliary tool provided with the fastening means defined above is shown in FIGS. 27 to 29.

From these Figures it will be apparent that the intermediate piece 153 comprises a bar 154 having stub shafts 155 at the ends, the aligned centre lines of which shafts form a rotary axis for the intermediate piece during the coupling operation, as will be described more fully hereinafter. With the aid of the connecting strips 156 the bar 154 has fastened to it an angle-section iron 157, forming a connecting member and located at least for the major part above and behind the rotary axis; the iron may have any desired length. Two ears 158 are secured to this angle-section iron in symmetrical portion with respect to the centre of the intermediate piece like the stub shafts 155. FIGS. 28 and 29 show by solid lines two ears spaced apart by a smaller distance than the stub shafts 155, but as is indicated schematically by broken lines a longer structure of the beam 157 permits of using a structure in which the ears 158*a* are spaced apart from each other by a larger distance than the stub shafts 155. Equal distances are, however, also possible.

At a given distance behind the beam 157 the ears 158 are connected with each other by a plate 159 similar to the plate 130 referred to above and having at one end open slots 160, which are also disposed at a distance from each other and symmetrically to the center independently of the length of the plate 159, which is adapted to the distance between the ears 158.

The bottom side of the plate 159 is provided with a square-section bar 161, which is provided at its ends with two circular portions or stub shafts 162, which are spaced apart from each other symmetrically to the centre of the intermediate piece.

The plates 158 have coupling holes 163, the position as well as the space between the plates 158 matching the type and/or make of excavator for which the intermediate piece 153 is intended to be employed. With the aid of the holes 163 the intermediate piece can be pivoted to the end of a boom and to the end of a setting cylinder coupled with the boom. For coupling with a beam the intermediate piece is turned with the aid of the setting cylinder with respect to the boom out of the position shown in FIG. 27 so that the plate 159 is at a higher level than the bar 154. In this position the bar 154 can be moved downwards so that the stub shafts 155 are urged into the recesses 144, which are open on the top and rear sides. By correctly manoeuvring the boom the stub shafts 155 can be gradually urged downwards in the parts 144 of the recesses in the ears 138 and then be slipped rearwardly into the parts 143 of the recesses. Subsequently the intermediate piece can be turned about the rotary axis formed by the aligned centre lines of the stub shafts 155 located in the recesses provided in the ears 138. At a given intant the stub shafts 162 will enter the recesses 150, after which the bolts screwed into the discs 152 can be turned so that they enter the slots 160, the bolts being subsequently tightened. During tightening of the bolts the stub shafts 162 are urged more deeply into the recesses 150. The position of the hindmost boundaries of the recesses 150 is such that the distance between these boundary lines and the centres of curvature of the boundary lines of the semi-circular recess parts 142 is gradually decreased. As a result, when the bolts screwed into the discs 152 are tightened, the stub shafts 155 (see FIG. 24) are urged to the left and always pressed against the boundaries of the recess parts 142. This ensures a satisfactory clamping of the intermediate piece on the trough. It will be obvious that for discouplng the intermediate piece from the soil-displacing trough or a different auxiliary tool the inverse order of operations is carried out.

Since the recess parts are located between the limbs of the angle-section iron bounding the open front of the trough, an advantageous disposition of the parts of the coupling members and the fastening means is again obtained so that the ears 158 to be positioned at arbitrary places can be provided at any desired area with holes for coupling the boom and the setting cylinder.

The embodiment shown in FIGS. 30 to 32 corresponds at least largely with the embodiment shown in FIGS. 15 to 20 and similar parts are designated by the same reference numerals.

In this embodiment the plate 127 is provided with two spaced sleeves 166, open only on the bottom side, for receiving hardened push studs 167, which are secured in the sleeves with the aid of safety bolts 168. The distance between the pressure studs 167 is equal to the distance between the pressure studs 164.

The plugs 120 have step chambers recessed in them. Each of the chambers holds a pressure stud 164, the lowermost part of which, having the smaller diameter, is secured in place by means of a safety bolt. The top surface of the hardened pressure stud 164 projecting above the plug 120 is slightly rounded off.

From FIG. 30 it will be apparent that during the coupling operation the hardened pressure studs 167 will bear on the hardened pressure studs 164.

Into the tapped holes 119 in the discs 118 are screwed sleeves 169 having inner and outer screwthreads, each sleeve having at the top a non-circular piece 170 being integral therewith and having, preferably the outward appearance of a nut. A bolt 171 is screwed into the sleeve 169. Care is taken for the pitch of the inner and outer threads of the sleeve 169 to be the same.

From FIG. 30 it will furthermore be seen that the bolt is passed to a ring 172 having on the bottom and top sides projecting parts 173 and 174 respectively which have a smaller diameter than the central portion of the ring 172. The ring 172 holds a plurality of dished springs 175 surrounding the bolt. The cup springs are surrounded by a sleeve 176, which is integral with a ring 177 fastened to the top end of the sleeve, on which bears the bolt head. The structure is chosen so that in the relaxed state of the cup springs 175 a defined distance is left between the top face of the central portion of the ring 172 and the bottom face of the sleeve 176. When the intermediate piece is coupled in the manner described above with the attachment, the bolts 171 can be turned by a turn about the stub shafts 117 into the position shown in FIG. 30, so that the bolts 171 enter the slots 131 and the lower ends 173 of the rings 172 get into recesses 178 provided for this purpose in the top part of the plate 130. The sleeve 169 with the nut 170 being integral therewith will occupy such a position that the top face of the nut 170 is free of the bottom face of the plate 130.

Subsequently, the bolts 171 are tightened until the bottom face of the sleeve 176 is apparently in tight contact with the top face of the central portion of the ring 172. When this position is attained, it is ensured that at the area of the coupling points at the stub shafts 123 and the pressure studs 164 and 167 the intermediate piece is clamped to the attachment with a given force, whilst at the bolts 171 a defined pre-stress is produced, the said forces and the pre-stress being accurately defined by the spring properties of the chosen cup springs 175.

Then the sleeve 169 with the nut 170 is turned along the bolt 171 in the hole 119 upwardly until the top face of the nut 170 tightly engages the bottom face of the plate 130. It will be evident that during this turn of the sleeve 169 the bolt 171 maintains the adjusted position since the pitch of the inner and outer threads of the sleeve 169 is the same. The pre-stress produced in the bolt 171 and hence also the forces by which the stub shafts 123 in the recesses 114 and the pressure studs 164 and 167 are pressed against each other are unaltered, whilst furthermore the plate 130 is immovably connected with the auxiliary tool. As a result no relative displacements under the action of forces produced in operation will any longer occur.

FIGS. 33 and 34 show a further embodiment of the fastening member by which the intermediate piece can be fastened to an attachment. Parts corresponding with those of the embodiment shown in FIGS. 30 to 32 are designated by the same reference numerals. From FIGS. 33 and 34 it will be apparent that in this embodiment the bolt 171 is directly screwed into the disc 118. Apart from each slot the plate 130 has a tapped hole 179 receiving a bolt 180. The head of each bolt 180 is located beneath the plate 130 and centrally above a plate 103.

In order to fasten the intermediate piece the bolt 171 is tightened in the manner described above until the desired pre-stress is produced. Subsequently the head of the bolt 180 is urged against the plate 103 by turning the bolt 180 in the hole 179. It will be obvious that also in this way the intermediate piece is immovably connected with the soil-displacing trough or a similar auxiliary tool, whilst in the bolts 171 a predetermined pre-stress is maintained. By tightening of the bolt 180 the forces produced are directly transferred to the plate 103, the shape of which is appropriate for withstanding these forces.

The embodiment shown in FIGS. 35 and 36 of the construction in accordance with the invention corresponds roughly with the preceding embodiments and corresponding parts are designated by the same reference numerals.

Also in this embodiment the bolts 171 are screwed directly in the discs 118. At the side of the tapped holes 119 in the discs 118 tapped holes 181 are provided in the discs 118 in parallel with the the holes 119. Bolts 182 are screwed into the holes 181, the heads of said bolts lying beneath the plate 130.

In the manner described with reference to the first embodiment the bolts are tightened for producing a given pre-stress in the bolts 171. Subsequently the bolts 182 are turned in order to urge the heads of the bolts 182 against the bottom face of the plate 130. Thus an immovable connection of the intermediate piece with the soil-displacing trough or the like is obtained, whilst a given prestress is maintained in the bolts 171. This construction has the advantage that in the event of damage of the screwthread in the taped holes the discs 118 can be readily exchanged so that any repair work required can be readily carried out.

It will be obvious that by using the constructions described in the foregoing a simple and rapid connection between the trough and the boom can be established so that the trough can be readily disengaged and replaced by another digging tool or trough provided with similar fastening members as the trough described above. Moreover, a far-reaching standardisation of the troughs is rendered possible so that a given trough can be used with several types and/or makes of excavators. In the various embodiment a particularly advantageous connection of the intermediate piece with the trough is obtained, since the fastening areas proper are located near the upper edge of the open front side of the trough and at a comparatively large distance behind the same so that the ears in which the connections for coupling the trough with the boom are to be provided can extend through a large are between these connecting areas, whilst at any location of the connecting points in said ears an advantageous transfer of forces to the fastening areas is yet obtained. Moreover, the various parts can be constructed simply and robustly, which is advantageous in view of the trough operations for which these constructions are used. The various constructions are not very sensitive for soiling, which is also an important advantage with such excavating tools.

It will be obvious that the constructions described above can be employed for any soil-working trough or the like, whilst the use is, of course, not restricted to troughs having closed top walls or the like.

What we claim is:

1. An excavator comprising a boom, a setting cylinder, and an intermediate piece pivoted to said boom for connection to an attachment, for example, a soil displacing trough, said attachment having locking means located near the upper front end of the trough, a fastening element positioned adjacent the upper rear end thereof and an intermediate upwardly facing abutment surface, said intermediate piece having two parallel interconnected parts in which connecting points are provided for pivotally connecting the boom and the setting cylinder, said connection point to the boom having a rotary shaft defining a rotary axis for the intermediate piece, said intermediate piece further having two spaced coupling members with the aid of which the intermediate piece is detachably connected with said attachment, one of said coupling members being positioned near the lower front edge of the intermediate piece and having a shape to permit insertion of a part thereof into engagement with the locking means of the attachment by rotation of the intermediate piece about said rotary axis to define a first coupling, the other coupling member being to the rear of said one coupling member and overlying said intermediate reaction surface and brought into engagement therewith by said rotation of the intermediate piece to provide a reaction coupling, and fastening means adjacent the rear of said intermediate piece and rearwardly of said coupling members having a fastening member engageable with said fastening element when the components of the first coupling and of the reaction coupling are engaged, and means operable after engagement between the fastening member and the fastening element for moving said fastening member in a direction to exert a pulling force on said fastening element and draw the rear parts of said intermediate piece and attachment toward each other and create a rotative force in a plane transverse to said rotary axis for downward compression of said other coupling member at the reaction coupling and a pull of said one coupling member against the attachment locking means to tighten the first coupling, said fastening means including a bolt insertable into the fastening element and spring mechanism formed by spring means surrounding the bolt and enclosed between two rings, and a spacer between said rings to limit the movement of the rings towards each other and hence compression of the spring means.

2. An excavator as claimed in claim 1 wherein the spacer is formed by a sleeve which is integral with one of the rings and which surrounds the spring means.

3. An excavator as claimed in claim 2 wherein the bolt is pivotally coupled with said attachment by means of a second sleeve and can be inserted into a slot of a plate forming part of the intermediate piece with the second sleeve located on one side of the plate and a head of the bolt with the spring means surrounding the bolt being located on the other side of the plate.

4. An excavator as claimed in claim 3 characterized in that a recess is provided in said plate for receiving the lower end of one of said rings surrounding the bolt, the diameter of said ring end being smaller than that of a ring portion located above said end.

5. An excavator as claimed in claim 3 wherein the bolt is screwed into the second sleeve having, in addition to an inner screwthread, an outer screwthread, the arrangement being such that when the bolt is tightened, the sleeve can be screwed tightly against the intermediate piece on the side remote from 6. An excavator as claimed in claim 5 wherein a second bolt is provided with the aid of which a force can be exerted on the intermediate piece in a direction opposite that of the force exerted by the spring means on the intermediate piece.

7. An excavator as claimed in claim 6 wherein said intermediate piece has a tapped hole receiving the second bolt and the head of said bolt cooperating with a vertical plate of the fastening means arranged on the attachment.

8. An excavator as claimed in claim 6 including a disc pivoted to one of said coupling members and the two bolts are screwed into said disc, the head of the second bolt cooperating with the lower side of a plate forming part of the intermediate piece.

9. An excavator comprising a boom, a setting cylinder, and an intermediate piece pivoted to said boom for connection to an attachment, for example, a soil displacing trough, said attachment having locking means located near the upper front end of the trough, a fastening element positioned adjacent the upper rear end thereof and an intermediate upwardly facing abutment surface, said intermediate piece having two parallel interconnected parts in which connecting points are provided for pivotally connecting the boom and the setting cylinder, said connection point to the boom having a rotary shaft defining a rotary axis for the intermediate piece further having two spaced coupling members with the aid of which the intermediate piece is detachably connected with said attachment, one of said coupling members being positioned near the lower front edge of the intermediate piece and having a shape to permit insertion of a part thereof into engagement with the locking means of the attachment by rotation of the intermediate piece about said rotary axis to define a first coupling, the other coupling member being to the rear of said one coupling member and overlying said intermediate reaction surface and brought into engagement therewith by said rotation of the intermediate piece to provide a reaction coupling, and fastening means adjacent the rear of said intermediate piece and rearwardly of said coupling members having a fastening member engageable with said fastening element when the components of the first coupling and of the reaction coupling are engaged, and means operable after engagement between the fastening member and the fastening element for moving said fastening member in a direction to exert a pulling force on said fastening element and draw the rear parts of said intermediate piece and attachment toward each other and create a rotative force in a plane transverse to said rotary axis for downward compression of said other coupling member at the reaction coupling and a pull of said one coupling member against the attachment locking means to tighten the first coupling, further including a profiled plate on said intermediate piece having a free, semicircular edge projecting away from the rotary shaft, and two spaced-apart vertical plates on said attachment which receive said profiled plate therebetween and having curved recesses on the lower side thereof positioned adjacent said locking means of the attachment to receive said semicircular edge whereby the intermediate piece is guided into engagement with the attachment by said profiled plate and the attachment may be lifted by a lifting force applied to said semicircular edge, said one coupling member having means defining a recess, and said locking means received in said recess, said coupling means being spaced from said edge of the profiled plate.

10. An excavator comprising a boom, a setting cylinder, and an intermediate piece pivoted to said boom for connection to an attachment, for example, a soil displacing trough, said attachment having locking means located near the upper front end of the trough, a fastening element positioned adjacent the upper rear end thereof and an intermediate upwardly facing abutment surface, said intermediate piece having two parallel interconnected parts in which connecting points are provided for pivotally connecting the boom and the setting cylinder, said connection point to the boom having a rotary shaft defining a rotary axis for the intermediate piece, said intermediate piece further having two spaced coupling members with the aid of which the intermediate piece is detachably connected with said attachment, one of said coupling members being positioned near the lower front edge of the intermediate piece and having a shape to permit insertion of a part thereof into engagement with the locking means of the attachment by rotation of the intermediate piece about said rotary axis to define a first coupling, the other coupling member being to the rear of said one coupling member and overlying said intermediate reaction surface and brought into engagement therewith by said rotation of the intermediate piece to provide a reaction coupling, and fastening means adjacent the rear of said intermediate piece and rearwardly of said coupling members having a fastening member engageable with said fastening element when the components of the first coupling and of the reaction coupling are engaged, and means operable after engagement between the fastening member and the fastening element for moving said fastening member in a direction to exert a pulling force on said fastening element and draw the rear parts of said intermediate piece and attachment toward each other and create a rotative force in a plane transverse to said rotary axis for downward compression of said other coupling member at the reaction coupling and a pull of said one coupling member against the attachment locking means to tighten the first coupling, further including a profiled plate on said intermediate piece having a free, semicircular edge projecting away from the rotary shaft, and two spaced-apart vertical plates on said attachment which receive said profiled plate therebetween and having curved recesses on the lower side thereof to receive said semicircular edge whereby the intermediate piece is guided into engagement with the attachment by said profiled plate and the attachment may be lifted by a lifting force applied to said semicircular edge, said one coupling member including two further vertical plates secured to the attachment and having at least semicircular recesses open on the lower side and positioned outside the aforementioned vertical plates having the curved recesses open on the lower side, said intermediate piece having stub shafts defining said locking means and fitting in said semicircular recesses and located at a given distance from the semicircular edge of said profiled plate.

11. In an excavator apparatus, connecting means for connecting an excavating attachment to an intermediate piece connected to a movable boom of the excavator apparatus, said connecting means comprising:

a cylindrical support on the intermediate piece and provided with means defining a reaction surface;

wall means defining a first recess on the attachment opening away from said reaction surface and a second, arcuate recess on the attachment adjacent said first recess;

a locking element on the intermediate piece slidably engaging said wall means in said first recess;

a reaction fulcrum pivot carried by said attachment and bearing against said reaction surface;

means on said intermediate piece defining a rotation axis rotatably received in said second recess; and adjustable fastening means carried by said intermediate piece and acting against a portion of the attachment to prestress said fulcrum pivot against said reaction surface and said means defining said rotation axis against said wall means defining said second recess about said rotation axis.

12. An excavator as claimed in claim 11 characterized in that near an open front side the excavating attachment is provided with a supporting member which forms an upper boundary of the opening across which, in operation, the material is pushed into the excavating attachment and defining a portion of said excavating attachment.

13. The excavator structure of claim 11 wherein said adjustable fastening means includes threadedly adjustable means.

14. The excavator structure of claim 11 wherein said adjustable fastening means includes spring-biased threadedly adjustable means.

15. The excavator structure of claim 11 wherein said locking means and means defining a rotation axis define with said reaction fulcrum pivot a triangle.

16. The excavator structure of claim 11 wherein said adjustable means comprises spring means and means for applying an adjusted clamping force to said spring means.

17. The excavator apparatus of claim 11 wherein said locking element comprises a semicircular bar.

18. The excavator apparatus of claim 11 wherein said adjustable fastening means comprises elements threaded into a sleeve carried by the excavating attachment.

19. The excavator apparatus of claim 11 wherein said rotation axis defining means comprise stub shafts.

* * * * *